US007594844B2

(12) United States Patent
Cartlidge et al.

(10) Patent No.: US 7,594,844 B2
(45) Date of Patent: Sep. 29, 2009

(54) TOY APPARATUS

(75) Inventors: Peter Cartlidge, Vauxhall (GB); Tim Rowe, Vauxhall (GB); Lucas Tyler, Vauxhall (GB)

(73) Assignee: Evolve NPD Ltd. (GB)

( * ) Notice: Subject to any disclaimer, the term of this patent is extended or adjusted under 35 U.S.C. 154(b) by 118 days.

(21) Appl. No.: 11/180,159

(22) Filed: Jul. 13, 2005

(65) Prior Publication Data

US 2006/0099875 A1 May 11, 2006

Related U.S. Application Data

(63) Continuation-in-part of application No. 11/122,676, filed on May 5, 2005.

(30) Foreign Application Priority Data

Nov. 9, 2004 (GB) ..... 0424690.6

(51) Int. Cl.
*A63H 3/52* (2006.01)

(52) U.S. Cl. ..... 446/148; 446/478; 446/75

(58) Field of Classification Search ..... 446/71–77, 446/80, 82, 108–110, 487, 478, 483, 486, 446/148; 206/45.28, 751–755, 768; 281/22, 281/38

See application file for complete search history.

(56) References Cited

U.S. PATENT DOCUMENTS 677,723 A * 7/1901 Walters ..... 446/310
1,258,788 A * 3/1918 Koch ..... 446/110
1,913,797 A 6/1933 Dulin et al. ..... 446/148
1,950,423 A 3/1934 Wightman ..... 446/70
2,511,211 A * 6/1950 Klein et al. ..... 206/45.28
2,544,783 A * 3/1951 Freedman et al. ..... 281/38
2,872,753 A * 2/1959 Fenton ..... 446/478
3,363,360 A * 1/1968 Ryan ..... 446/478
3,798,806 A * 3/1974 Sanford ..... 40/124.03
3,855,726 A 12/1974 Yumoto ..... 446/148
4,055,250 A * 10/1977 Mayhew ..... 206/457
4,161,081 A * 7/1979 Katzman et al. ..... 446/314
4,319,424 A * 3/1982 Goldfarb et al. ..... 446/268
4,516,948 A * 5/1985 Obara ..... 446/95
4,575,348 A * 3/1986 Wiggs et al. ..... 446/310
4,883,443 A * 11/1989 Chase ..... 446/478
4,937,207 A * 6/1990 Simmell et al. ..... 463/62
5,429,432 A * 7/1995 Johnson ..... 312/235.3
5,435,769 A * 7/1995 Bertrand ..... 446/476
5,682,999 A * 11/1997 Larson ..... 206/768
5,687,992 A * 11/1997 Finkelshteyn ..... 283/117

(Continued)

FOREIGN PATENT DOCUMENTS

EP 0920893 A2 6/1999

(Continued)

*Primary Examiner*—Nini Legesse
(74) *Attorney, Agent, or Firm*—Winstead P.C.

(57) ABSTRACT

A toy apparatus is provided including a playbase movable between a first closed position and a second open position. The playbase includes one or more members and these members are provided in a substantially flattened condition when the playbase is in a first closed position, and movable with the playbase to a partial or substantially erect condition when the playbase is in a second open position. At least one of the members is provided in at least one recess in the playbase in the first closed condition.

60 Claims, 21 Drawing Sheets

U.S. PATENT DOCUMENTS

| | | | | | |
|---|---|---|---|---|---|
| 5,961,149 | A | * | 10/1999 | Hunt | 281/22 |
| 6,099,380 | A | * | 8/2000 | Rasmussen | 446/478 |
| 6,108,982 | A | * | 8/2000 | Davison | 52/64 |
| 6,146,238 | A | * | 11/2000 | Daiber | 446/478 |
| 2006/0286891 | A1 | * | 12/2006 | Knight et al. | 446/75 |

FOREIGN PATENT DOCUMENTS

| | | | |
|---|---|---|---|
| JP | 2003071151 | A | 3/2003 |
| WO | WO 2006/133070 | | 12/2006 |

* cited by examiner

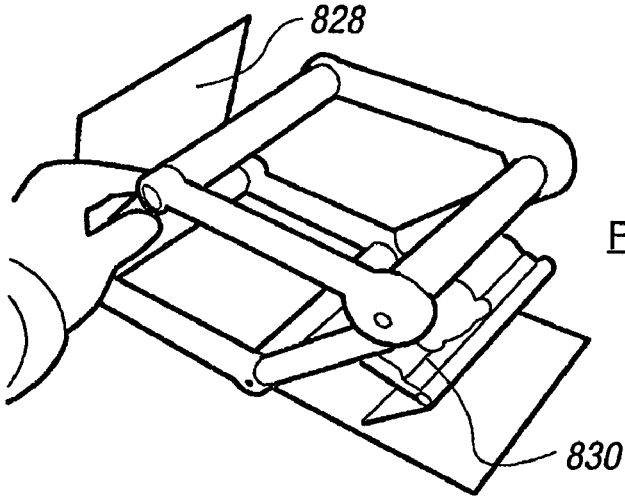
FIG. 12b
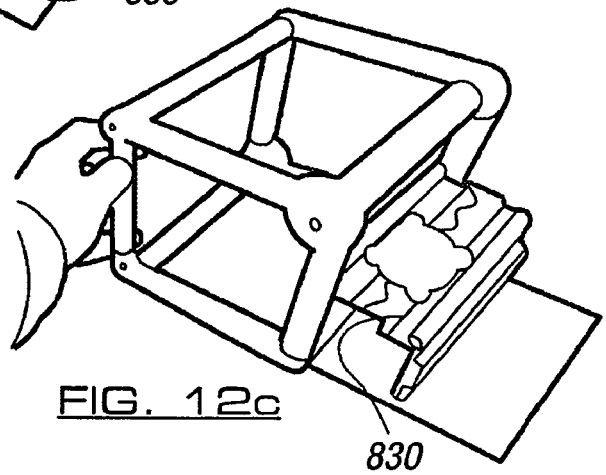
FIG. 12c
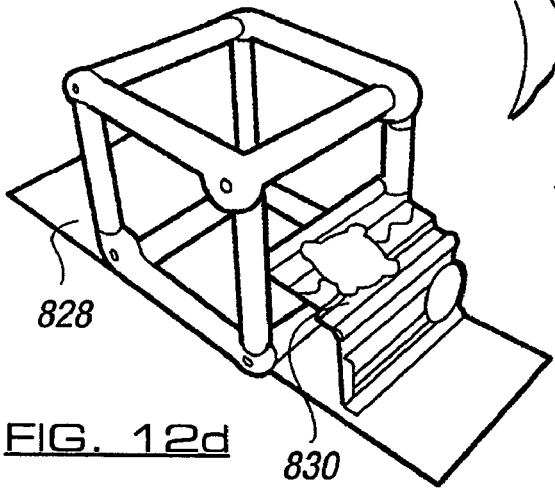
FIG. 12d
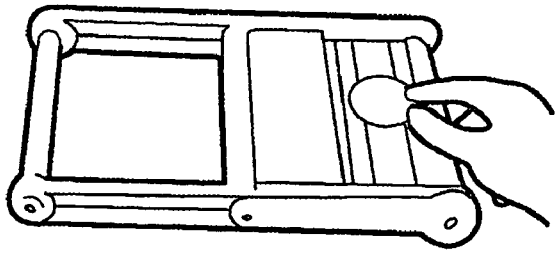

TOY APPARATUS

CROSS-REFERENCE TO RELATED APPLICATION

This application is a Continuation-in-Part of U.S. Ser. No. 11/122,676 filed on May 5, 2005 by inventors Peter Cartlidge, Tim Rowe and Lucas Tyler.

This application also claims priority to U.S. application Ser. No. 0424690.6 filed on Nov. 9, 2004.

BACKGROUND OF THE INVENTION

1. Field of Invention

The present invention relates to toy apparatus.

2. Background of Invention

It is known to provide toy apparatuses which need to be assembled prior to use. For example, such toy apparatuses may include a plurality of members which need to be interconnected together to form a pre-determined structure and a user typically moves one or more toy members, such as a toy doll, toy animal or toy vehicle about said structure during use. The advantages of such toy apparatuses is that the members of the apparatus can be separated from each other and packed away in a box or similar container in a more compact form when not being used, such that the apparatus takes up less space in an out of use storage condition than in an in use erect condition. However, a problem with the abovementioned prior art apparatus is that it is time consuming for a user to have to erect the apparatus each time they wish to use the same. In addition, it is often the case that parts or members of the apparatus get separated from the container they are being stored in and become lost, thereby rendering the toy apparatus useless or at least reducing the enjoyment of the toy to a user.

It is therefore an aim of the present invention to provide toy apparatus which does not require time consuming assembly of the same when moved from a stored condition to an in use condition.

It is a further aim of the present invention to provide a method of construction of toy apparatus.

SUMMARY OF INVENTION

According to a first aspect of the present invention there is provided toy apparatus, said apparatus including a playbase movable between a first closed position and a second open position, said playbase including one or more members and said members provided in a substantially flattened condition with said playbase in said first closed position and movable with said playbase to a partial or substantially erect condition with respect said playbase in said second open position and wherein at least one of said one or more members is provided in at least one recess in said playbase in said first closed condition.

In the flattened condition, an upper or outer surface of the members can be substantially flush with a surface of the playbase, the members can be substantially parallel to and adjacent the playbase surface and/or recessed in the surfaces of the playbase. In the erect condition, the members typically protrude outwardly of the surface of the playbase. In one embodiment, with the playbase in the open position, the members can protrude substantially perpendicularly or at an acute angle with respect to the playbase surface. Thus, in one embodiment of the present invention, a toy apparatus is provided where at least one or more of the members on the apparatus "pop-up" automatically on opening of the apparatus or following actuation of a suitable mechanism, thereby removing the requirement for a user to manually erect and/or dismantle interconnecting portions of the apparatus in use (i.e. without user manipulation required). As such, the toy can be used quickly and easily and can also be moved to a closed position both quickly and easily.

The first closed position typically corresponds to an out of use storage position and the second open position typically corresponds to an in use position.

In one embodiment the members of the apparatus are typically substantially rigid members. In addition, or as an alternative, one or more of the members can be substantially flexible.

Preferably one or more recesses on the playbase are of a substantially similar shape and/or dimension to the one or more members which are located therein. Alternatively, one or more of said recesses are of a different shape or size with respect to said one or more members located therein.

The members can be formed by cutting the same from the surface of the playbase and/or the members can be formed from a different source and attached to a surface of the playbase. The different source can include the same or a different material.

In one embodiment lip means are provided on the walls or leaves forming the playbase and the lip means define a recess portion therebetween. Thus, for example, lip means can be provided adjacent a peripheral edge of the internal surfaces of the playbase walls and the recess portion or portions is the area defined within or between the peripheral edge. The lip means typically protrude outwardly of the playbase when said playbase is in an open condition.

In one embodiment the playbase includes or is formed from frame means. The frame means can be joined together in a required shape and configuration to form a playbase or playarea and/or one or more of the frame means can be or include the members movable from a substantially flattened condition to a substantially erect condition on opening of the playbase.

The one or more recesses can be defined between the frame means and one or more "pop-up" members can be located between the frame means in said recesses when the playbase is in said closed position. The frame means can be located in one or more recesses defined in the playbase if required.

Preferably the playbase includes a plurality of members and each of said members is provided with a correspondingly shaped recess therefor. Alternatively, two or more members can be located in a single recess. The two or more members can be located side by side in the recess or can be located in an overlapping relationship to form, for example, a stack of members in the recess of the playbase in a closed position. In the stack, each member is typically provided in overlapping arrangement with one member located above or below a further member. The recess can be provided with different levels associated therewith to accommodate different sized or shaped members.

In one embodiment two or more members form a structure, article and/or the like when moved to an erect condition. Thus, for example, a member can be separate to another member in the flattened condition and can engage with, abut against and/or is associated with at least one further member when moved to an erect condition, such that the combination of members forms a pre-defined shape and/or object. Alternatively, the members can be connected in the flattened condition and are moved to form a structure, article and/or the like in the erect condition.

Preferably one or more of said members are hingedly, rotatably, foldably and/or pivotally mounted to at least one surface of said playbase.

Preferably one or more of said members are resiliently biased to an erect condition via resilient biasing means.

In one embodiment the resilient biasing means can be associated with the hinge means or can be separate thereto. Thus, for example, sprung hinges or sprung metal can be used to attach the one or more members to a surface of the playbase.

In one embodiment one or more members are connected to an adjacent member by moveable connection means, such as via pivotal, rotational, foldable and/or hinge means and any number of members can be connected together as required. Thus, one or more members can follow the movement of one or more other members when being moved from a collapsed to an erect condition via said moveable connection means.

The hinge means can be in the form of detachably attached magnetic hinge means in one example.

The surfaces of the playbase and/or members are typically provided with printed matter, graphics, texture, colour, photographs, text, one or more characters, images and/or the like which together create a scene or toy and/or the like.

In one embodiment the playbase includes at least front and rear walls or leaves which are substantially parallel and adjacent to each other in said first closed position. The front and rear walls/leaves are typically movable relative to each other to a configuration where internal opposing surfaces of the playbase are moved a spaced distance apart from each other. For example, the surfaces of the playbase which are internal to the playbase and opposing each other in the closed position can be moved to a substantially planar or flat configuration in a second open position.

Preferably hinge or pivot means are provided between said at least front and rear walls to join the same together and to allow the same to be moved between open and closed positions. Thus, the playbase includes at least two parts movable between said open and closed positions.

In a preferred embodiment two or more members are provided on said playbase. At least one member is provided on or in association with an inner surface on one part or front wall of the playbase and at least one further member is provided on or in association with an inner surface of another part or rear wall of the playbase when in said closed position. The two members are joined together along a whole or at least part of an edge or surface, such that when the parts of the playbase are moved to an open position, the engagement between the members causes the members to move from a flattened condition to an erect condition. This engagement in one example is via hinge means. The hinge means or engagement means are preferably located substantially centrally between the members over the join or hinge between the playbase parts. Thus, in this embodiment, resilient biasing means are not required.

Members which are not provided over or associated with the hinge or join between the parts of the playbase typically require to be moved from a flattened condition to an erect condition by resilient biasing means, manually and/or via other mechanical means.

The at least front and rear walls of the playbase have inner and outer surfaces and at least the outer surfaces thereof typically have at least one substantially flat or planar surface such that said playbase can be easily balanced or supported on the outer surfaces of said front and rear walls with the playbase in a second open position in one embodiment.

The toy apparatus can be used in a substantially horizontal orientation when in an in-use position and/or can be used in a substantially vertical or angled orientation. For example, in the embodiment where the playbase includes at least first and second surfaces joined together via a hinge or pivot type of mechanism, the surfaces of the playbase can be moved between 0-360 degrees with respect to each other. The surfaces of the playbase can then be supported via one or more edges of said surfaces in a vertical or angled position. The shape and design of the members on the playbase can be altered to allow them to used in a vertical or angled position.

In one embodiment the toy apparatus forms a flat case or container in said first closed position. The walls of the playbase can form one or more walls of the case or container or the playbase can be located in a case or container as required. The exterior surfaces of said case or container in one embodiment could be non-planar in form.

In an alternative embodiment the two or more walls, panels, leaves or surfaces forming the playbase differ in shape, size and/or design. One of the walls or surfaces may be located partially or wholly within the outermost boundaries of a second wall, panel, leaf or surface in at least the closed position.

In one embodiment the playbase forms only a part of the overall toy apparatus. Thus, for example, the toy apparatus could be in the form of a doll, animal, human or character and the playbase element could form a part of the doll, human, animal or character.

In one embodiment one or more handle means are provided on said apparatus to allow a user to easily transport the apparatus in said first closed condition.

One or more compartments can be provided in the hinge means of the toy apparatus in use if required. The one or more compartments can be used to store one or more pop-up members and/or free standing play pieces.

The members provided on the playbase could be moved to provide two or more levels or tiers. The two or move levels may be formed substantially simultaneously on opening of the playbase or the levels may be formed in a one or more stage process after opening of the playbase. The levels or tiers are typically spaced apart in a vertical direction or plane.

Further toy pieces can be located on the playbase and/or in association with the members when the playbase is in an open condition.

According to a second aspect of the present invention there is provided a method of manufacture of toy apparatus.

According to a further aspect of the present invention there is provided a method of use of the toy apparatus.

According to a further aspect of the present invention there is provided toy apparatus, said apparatus including a playbase movable between a first closed position and a second open position, said playbase including one or more members and said members provided in a substantially flattened condition with said playbase in said first closed position and movable with said playbase to a substantially erect condition with said playbase in said second open position and wherein said playbase is in the form of a case or container in said first closed position.

The toy apparatus of the present invention differs from a conventional pop-up type book in that the pages of a book do not form a playbase surface on which one or more further toy members can be provided as in the present invention. The pop up members in books do not generally sit in recesses in the book when in a closed condition as in the present invention and therefore adjacent pages of a book cannot normally be moved to a directly abutting or flat position. As such, the pages of a pop-up book cannot normally be brought into contact with each other as in the present invention. Thus, the present invention provides a substantially flat apparatus wherein the surfaces of the playbase can be brought into abutting and overlapping relationship with each other in said closed position. Pop-up members are attached to pop-up books by adhesive which is not the case in the present invention. The weight of the playbase in the present invention can be sufficient to maintain the playbase in an open condition and/or locking means can be used. No such features are available in conventional pop-up books.

It is to be noted that although in one embodiment the "in-use" position or play position provides the surfaces of the playbase in a flat substantially planar arrangement, such that any intermediate position between said open and closed positions has no play value to a user, one or more intermediate positions could be provided to have play value associated therewith. For example, with two or more parts of the play base located in an intermediate position, the parts could be approximately 90 degrees to each other and the members on the playbase could be in an erect or partially erect condition which has some play value, thereby allowing the toy to be used in said partially open position or intermediate position. The parts could have play value associated therewith at other angles, such as 180 degrees, 270 degrees, 360 degrees or any angle therebetween.

Different levels of play could be obtained with the parts of the playbase being separated at different angles. The different levels of play could relate to different members being erect, different structures being formed and/or the like.

BRIEF DESCRIPTION OF DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following descriptions taken in conjunction with the accompanying drawings, in which:

FIGS. 8*a*-8*d* illustrate an embodiment of the toy apparatus wherein the members of the playbase create two or more tiers or levels of the playbase for a user to play on;

FIGS. 12*a*-12*d* illustrate an embodiment of the present invention based on the embodiment shown in FIGS. 11*a*-11*e*, with one or more movable "pop-up" members.

DETAILED DESCRIPTION OF THE INVENTION

Figures 1A, 1B, 1C:
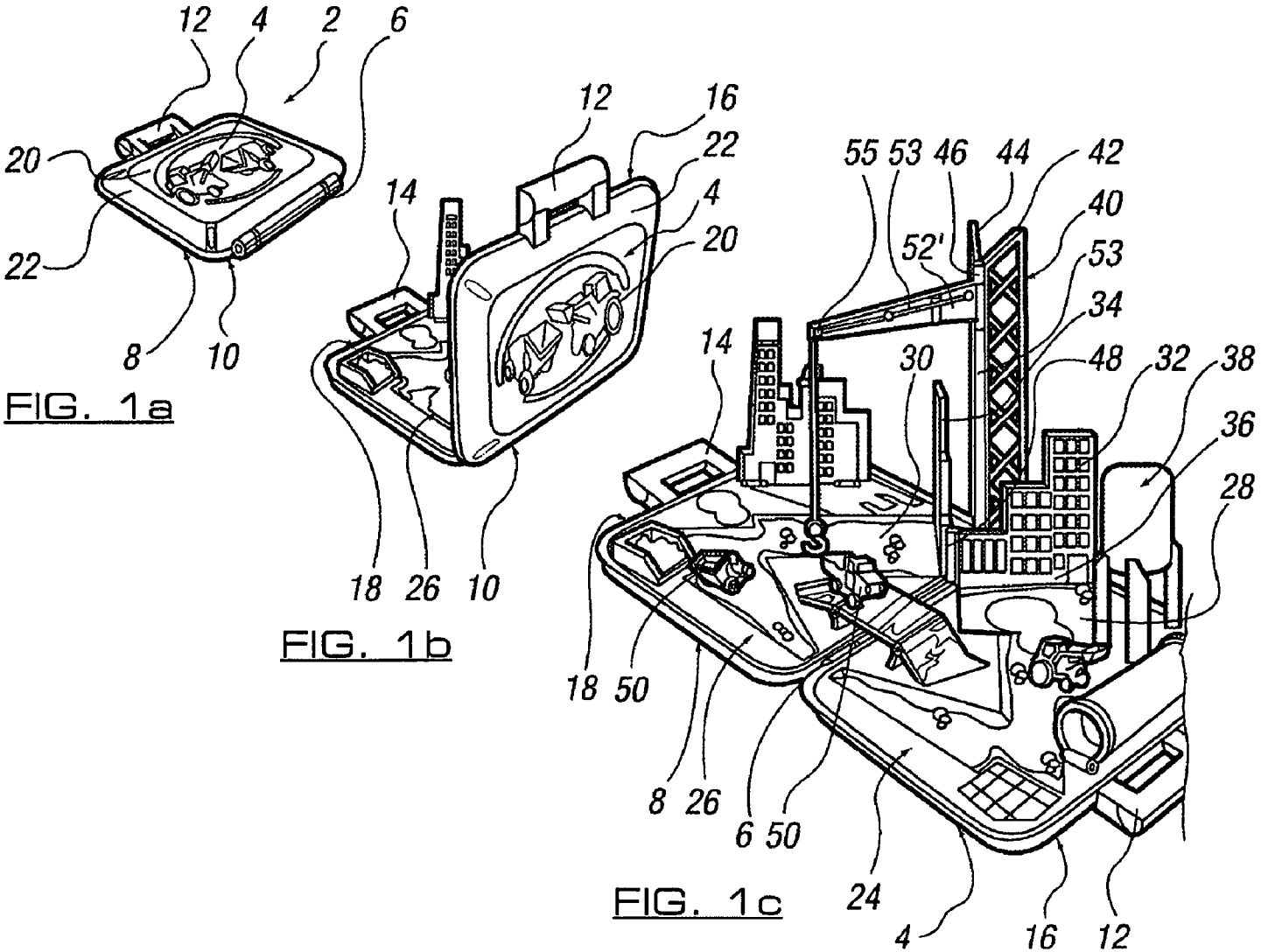
FIGS. 1*a*-1*c* illustrate the steps involved in moving toy apparatus according to an embodiment of the present invention between a first closed position, an intermediate position and a second open position respectively.

Referring to FIGS. 1*a*-1*c*, there is illustrated a toy apparatus in the form of a case 2.

The case 2 includes a front surface 4 which is hingedly connected via hinge 6 to a rear surface 8. Hinge 6 is provided along an edge 10 of case 2 and handle portions 12, 14 are provided along an opposite edge 16, 18 of each of front surface 4 and rear surface 8.

The front and rear surfaces 4, 8 have a raised or protruding portion 20 which is substantially flat and planar. A peripheral border 22 slopes towards the edges of said surfaces. With the case in an open position, as shown in FIG. 1*c*, the apparatus balances on a suitable surface on portions 20 of the front and rear surfaces 4, 8.

Case 2 is movable between a first closed position, as shown in FIG. 1*a*, to an intermediate position, shown in FIG. 1*b*, to a second open position, as shown in FIG. 1*c*.

The opposite and inner surfaces 24, 26 to front and rear surfaces 4, 8 respectively form a playbase in the second open position.

A plurality of shaped recesses 28, 30 are defined in surfaces 24, 26 and said recesses house correspondingly shaped members 32, 34 when case 2 is in said first closed position. Members 32, 34 are hingedly connected to surfaces 24, 26 via hinges provided along base edges 36 thereof. These hinges, together with hinge 48 provided along side edges of the members 32, 34 connect the same together and allow members 32, 34 to move to an erect upright condition, wherein the members are designed and shaped to be in the form of buildings. Graphics, texture, colour, printed matter and/or the like can be provided on the surface of the recesses and playbase to create a scene, which in the example illustrated is of a building site.

Other members can be provided on the playbase, such as a water cooling tower 38, crane 40 and/or the like. These members can be hingedly connected to surfaces 24, 26 via sprung hinges, such that the members move to an erect position when panels 24, 26 are separated. Alternatively, these members can be manually lifted or can be moved to an erect condition by other mechanical means.

Some of the members, such as crane portions 42, 44 and members 32, 34 are hingedly connected to each other via an edge other than a base edge, such as side edge 46, 48. In the illustrated embodiment this hinge is provided centrally of the members and the hinges 46, 48 are substantially perpendicular to hinge 6 provided between surfaces 24, 26. It is these hinges or connecting edges 46, 48 which allow automatic erection of the crane and other structures when the playbase is opened. The portions or members which are hingedly connected together can be substantially symmetrical in form or can be asymmetrical in form. Crane 40 can also be provided with an arm portion 52, 52' which can be moved between a folded condition when the case is in first closed position and an erect condition when the case is in the second open position. Portions 52, 52' can be hingedly connected together via a sprung hinge so that the arm portion moves from the folded condition to the erect condition automatically on opening of the case. Alternatively, portions 52, 52' are manually movable by a user between said folded and erect conditions. Portions 52, 52' are slidably mounted on hinge or edge 46 and can be moved by movement of a string or cord 53 provided between end 55 and the base of the crane. Thus, one or more of the members have one or more further portions movable relative thereto.

Additional toys can be placed on the playbase in use, such as trucks 50 and/or the like.

A locking means can be provided on case 2 to lock the same in the first closed position and/or the second open position. For example, one or more clips, friction fit, latch and/or the like can be provided on front and/or rear surfaces 4, 8 to allow the case to be maintained in the first closed position.

Referring FIGS. 2*a*-3*c*, there is illustrated a partial view of a case showing a simplified playbase 102 with the outer casing of the toy apparatus removed and only the playbase surfaces viewable.

The playbase 102 includes two substantially flat and planar panels 104, 106. Each panel 104, 106 has a front surface 108, 110 and a rear surface 112, 114 respectively. Panels 104, 106 are joined together along edge 116 via a hinge 118.

A plurality of members 120, 122, 124 are cut out of panel 104 and similarly shaped and sized plurality of members 126, 128, 130 are cut out of panel 106.

Member 124 is connected to panel 104 via hinge 132. Member 122 is connected to member 124 along edge 134 via a sprung hinge and is not connected to panel 104; and member 120 is connected to member 122 along edge 136 via a sprung hinge and is also not connected to panel 104.

Member 128 is connected to panel 106 via a sprung hinge 138. Member 126 is connected to member 128 along edge 140 via a sprung hinge, and member 130 is connected to member 128 along edge 142 via a sprung hinge.

Member 126 on panel 106 is hingedly connected to member 122 on panel 104 along edge 150 and member 124 on panel 104 is hingedly connected to member 128 on panel 106 along edge 152. It will be appreciated that any arrangement of member connections can be provided.

Figure 2A:
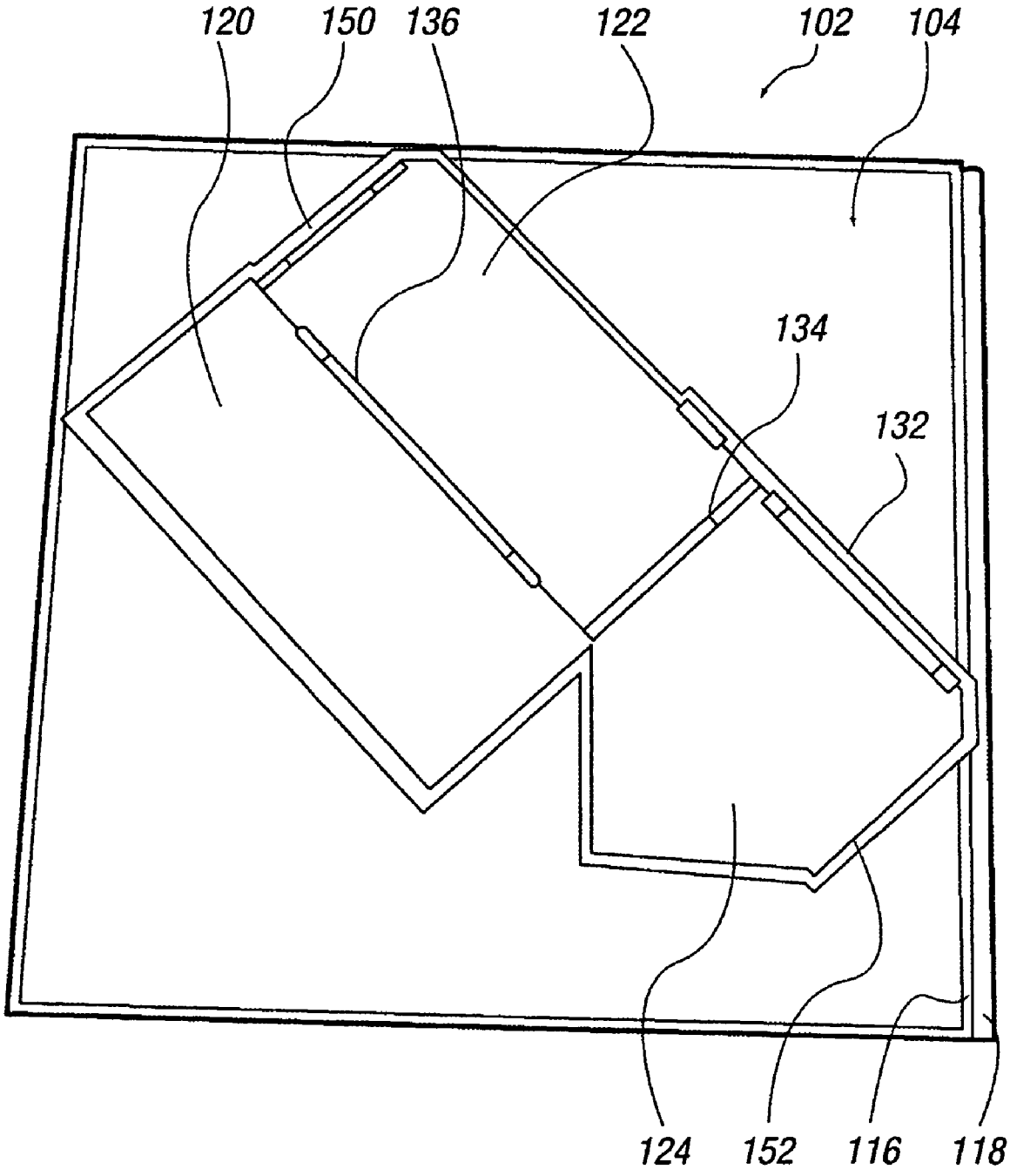
FIGS. 2*a* and 2*b* illustrate a plan view and perspective view respectively of a part of a playbase according to an embodiment of the present invention in a closed position.
Figure 2B:
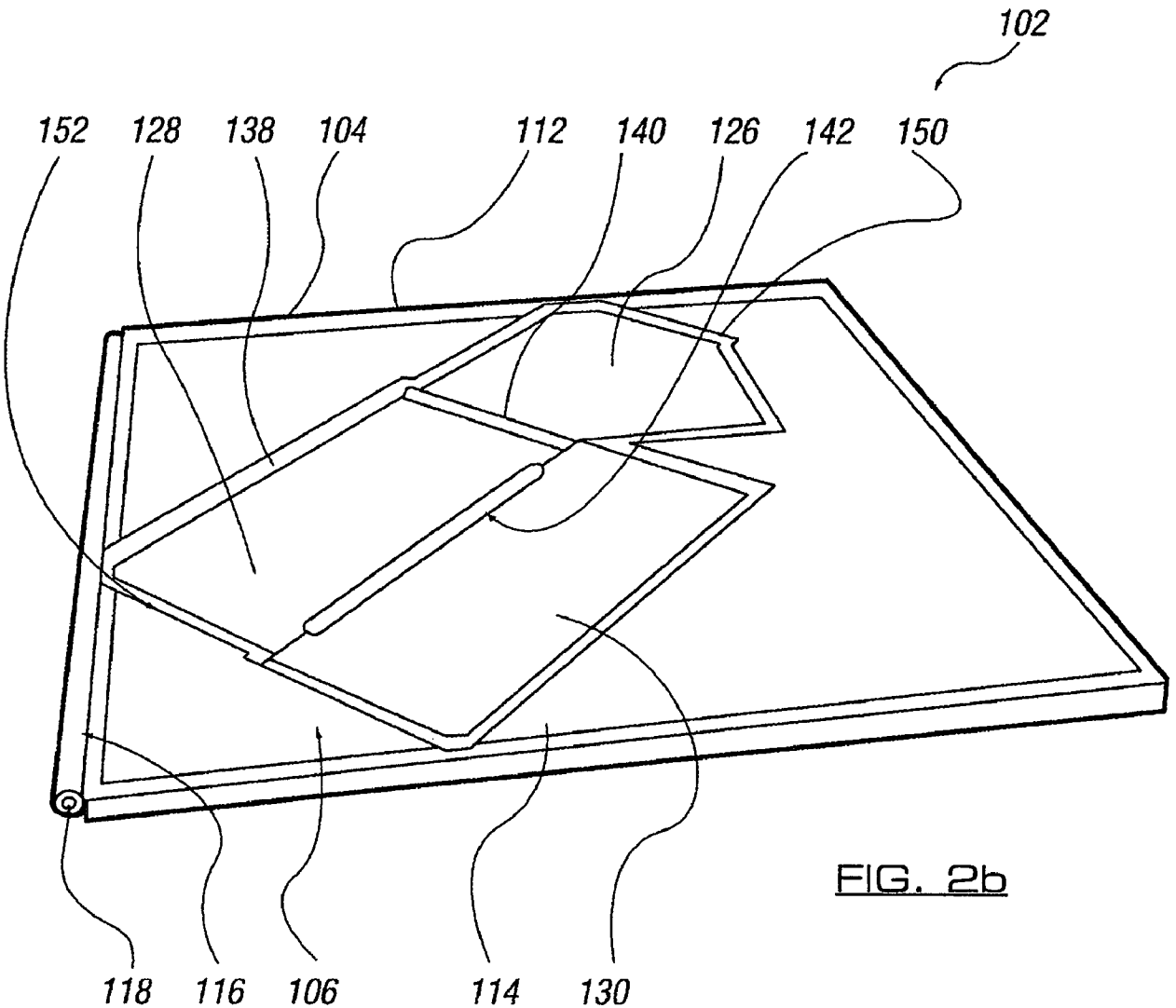
Figure 3A:
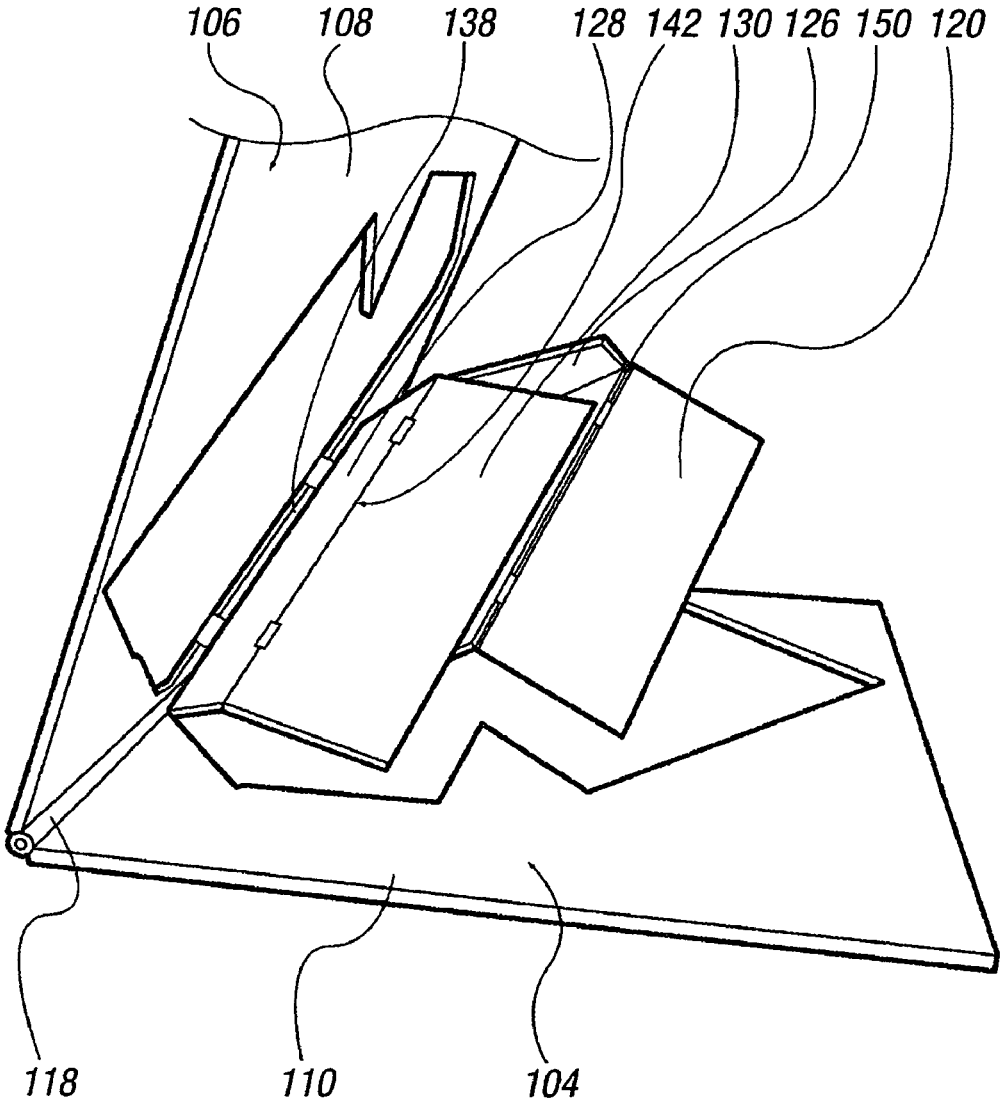
FIGS. 3*a*-3*c* illustrate the stages of moving one or more members on the playbase in FIGS. 2*a* and 2*b* from a flattened condition to an erect condition.
Figure 3B:
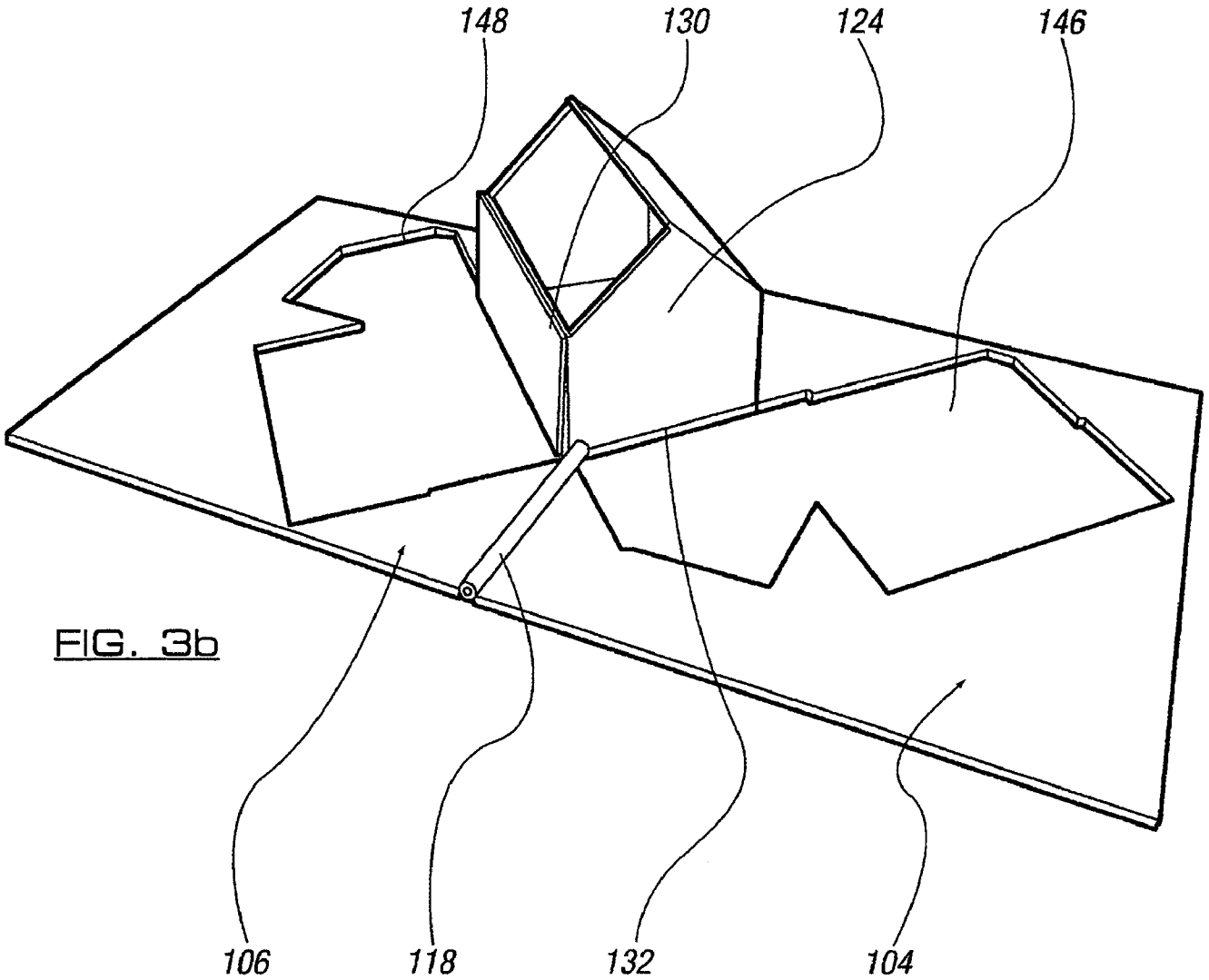
Figure 3C:
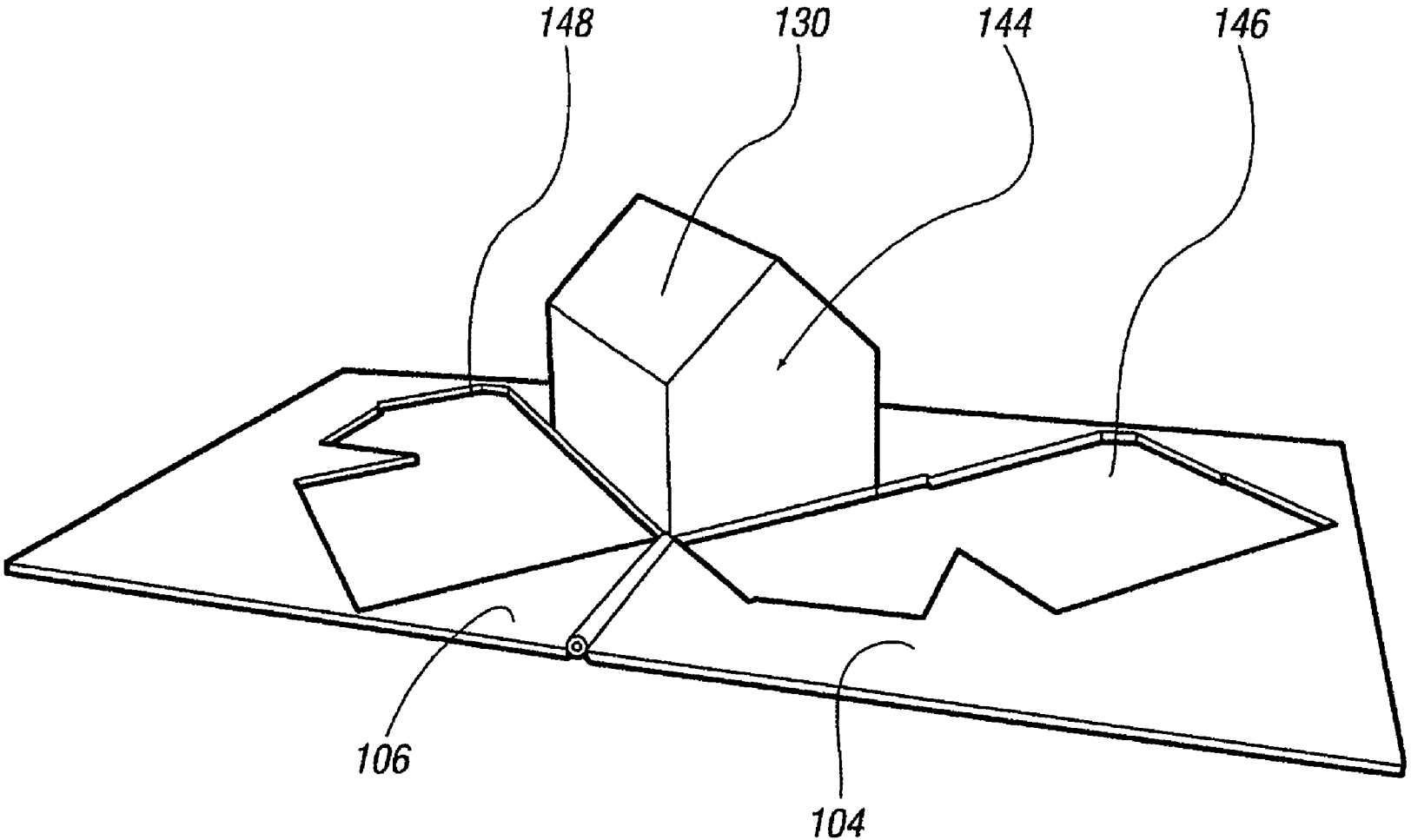

Thus, each panel has similarly shaped members but the members are hingedly connected together in a different manner, such that on separation of the panels to an open configuration, as shown in FIGS. 3*b* and 3*c*, the members move relative to each other to abut against each other to form a building 144. In moving the members from a flat condition, as shown in FIGS. 2*a* and 2*b*, to an erect condition, as shown in FIGS. 3*b*, 3*c*, recesses or cut out portions 146, 148 are defined in panels 104, 106 respectively.

The hinges can be sprung hinges, such that the members are bias to an erect condition. Alternatively, or in addition, the hinges need not be sprung. Movement of the panels from an adjacent parallel position to a separated planar position can be sufficient to allow the members to move from a flattened condition to an erect condition. In FIG. 3*b*, it can be seen that member 130 is required to be manually moved to complete building 144 in its final erect condition, as shown in FIG. 3*c*. A sliding hinge could be used so that no manual movement is required. When formed, a structure on the playbase could be opened or moved to allow a user to gain access to the same. In one example, this is undertaken by allowing one or more hinges or attachment means between members to be removable or detachable.

The panels 104, 106 can be located with a casing as required to form toy apparatus similar to that shown in FIGS. 1*a*-1*c*. The rear surface of the panels could also form the outer casing surface in one embodiment if required.

The members can be typically formed from sheet material which is typically substantially flat and planar in form, a plurality of members interacting to form a non-planar or three dimensional structure when the apparatus is moved to an open position. The members and the apparatus can be formed from any suitable material but is typically formed from a substantially rigid material or flexible material; such as plastic, metallised plastic material and/or metal. Paper, cardboard and/or wood, rubber or fabric could also be used.

Figure 4A:
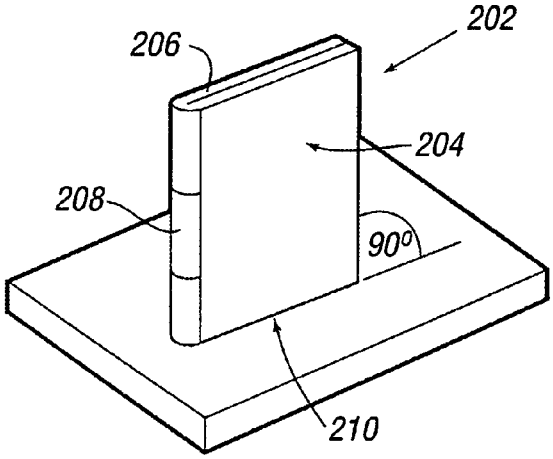
FIGS. 4*a*-4*d* illustrate an embodiment of the toy apparatus when used in a substantially vertical orientation.
Figure 4B:
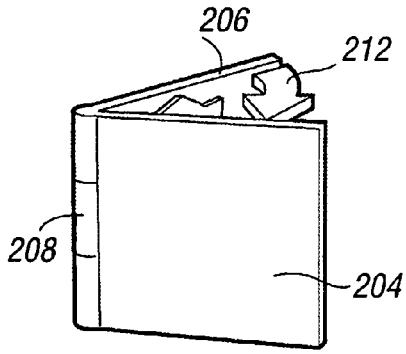
Figure 4C:
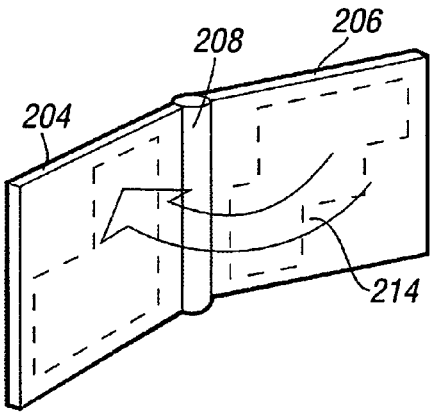
Figure 4D:
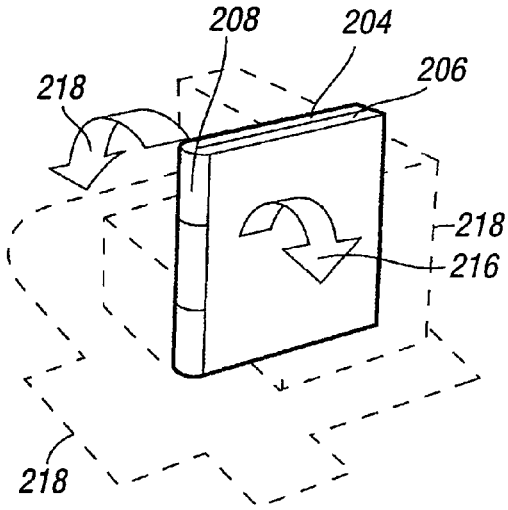

Referring to FIGS. 4*a*-4*d*, there is illustrated an embodiment wherein the toy apparatus 202 is used in a substantially vertical orientation. The apparatus 202 includes a front playbase leaf 204 and a rear playbase leaf 206 joined together via a hinge mechanism 208. The apparatus can be balanced on a suitable surface on edges 210, as shown in FIG. 4*a*, and leaves 204, 206 can be separated by rotating the same outwardly of each other about hinge 208, as shown by arrows 212 in FIG. 4*b* and arrow 214 in FIG. 4*c*. Although the apparatus could be used in any intermediate angle between 0-360 degrees, in the illustrated example, the external surfaces of the playbase leaves are moved into abutting parallel relationship with each other such that the internal surfaces of the playbase leaves now face outwardly of the apparatus. The pop-up members located in the apparatus can then extend outwardly from the leaves, as shown by arrows 216 and dotted lines 218.

In a further example, movement of the playbase leaves through a particular angle could activate actuation of one or more members provided on the playbase, such as actuating "popping up" of the members. Thus, contact of the external surfaces of the leaves into abutting relationship with each other could activate protrusion of one or more members from the internal leaf surface or surfaces.

Figure 5A:
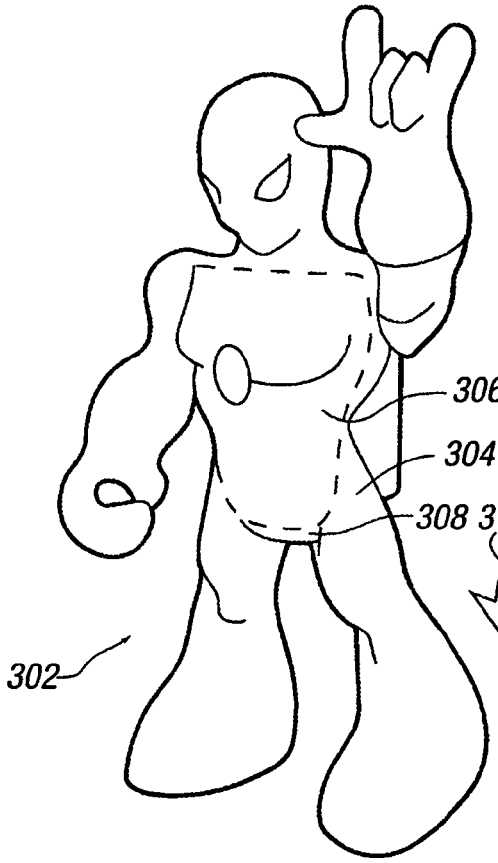
FIGS. 5*a* and 5*b* illustrate an embodiment of the toy apparatus, in a closed and open position respectively, when the walls of the playbase differ in size and shape to each other.
Figure 5B:
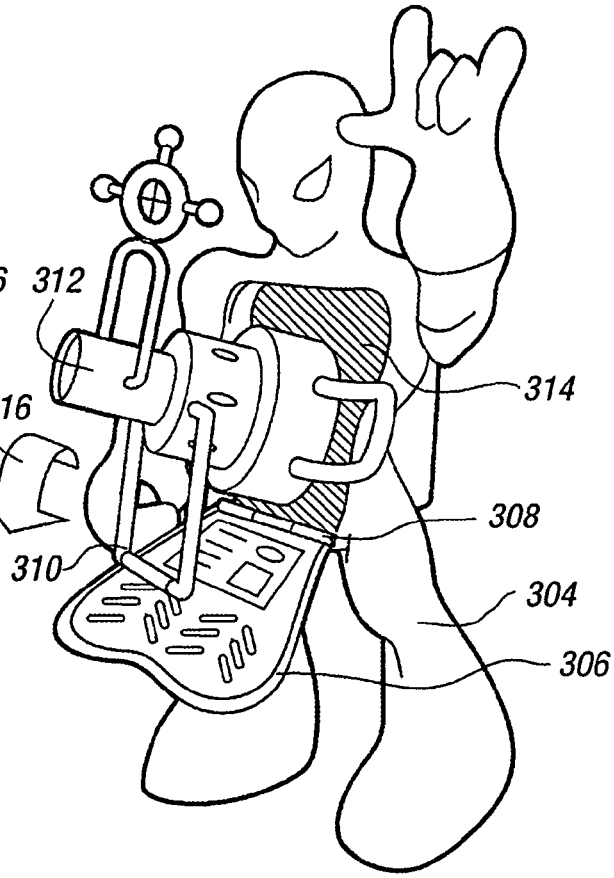

Referring to FIGS. 5*a* and 5*b*, there is illustrated an embodiment of the present invention wherein the walls of the playbase differ in size and shape to each other. The toy apparatus 302 includes a playbase having a first wall 304 in the form of an action figure or toy character having a head, body, arms and legs, and a second wall 306 which is hingedly connected to first wall 304 via hinge 308. The second wall 306 forms part of the chest of the action figure. Pop out members 310, 312 in the form of a gun located on the second wall and first wall respectively, are located in recess 314 defined in first wall 304 with the playbase in a closed position. On opening of the playbase by pivoting second wall 306 with respect to first wall 304, members 310, 312 move with second wall 306 to an erect position where they protrude outwardly from the toy apparatus, as shown by arrow 316. Thus, first wall 304 is substantially larger and non-planar in form, whereas second wall 306 is smaller and fits within the boundaries of first wall 304.

Figure 6A:
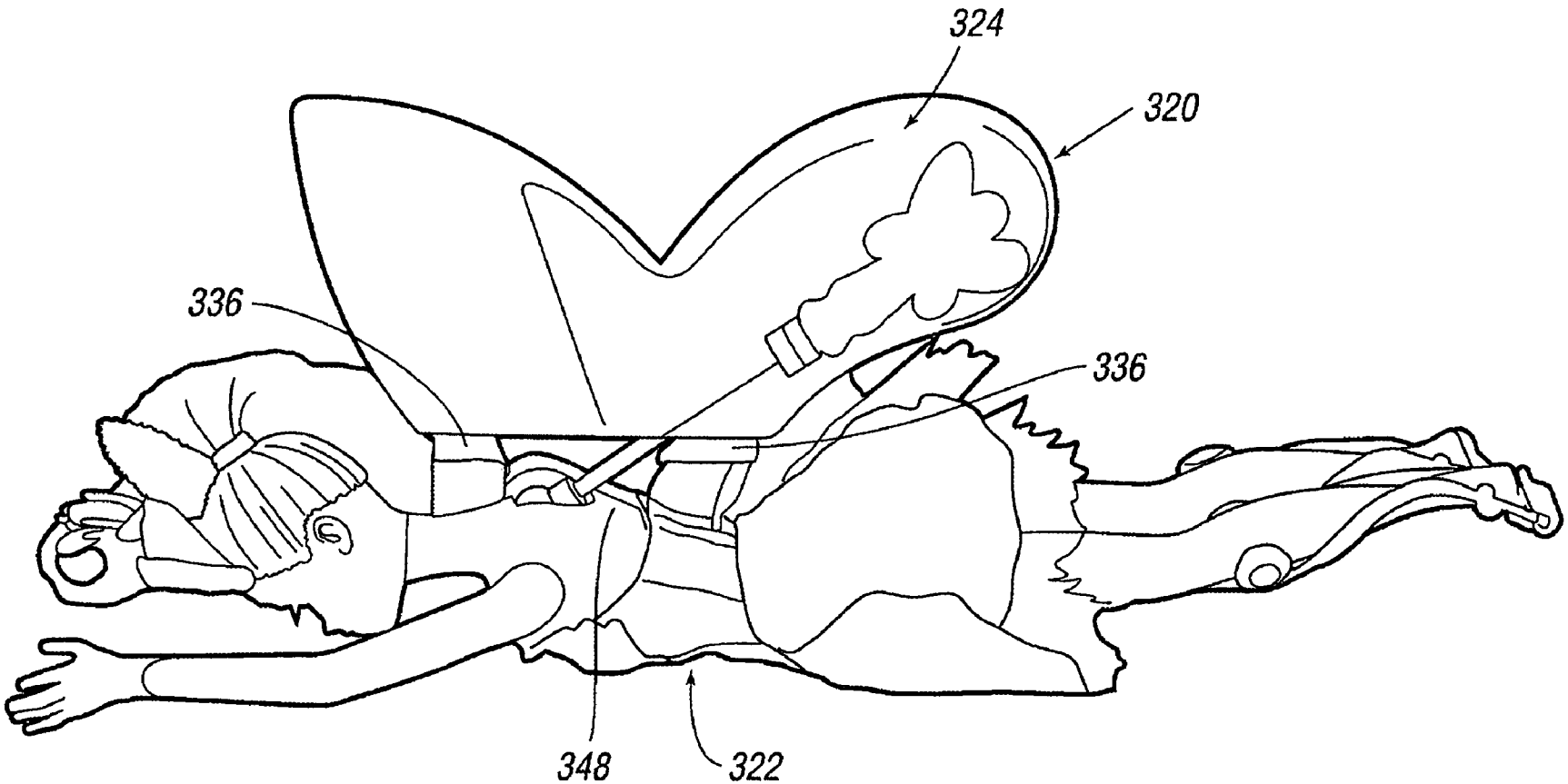
FIGS. 6*a* and 6*b* illustrate an embodiment of the toy apparatus in a closed and open position respectively, wherein the walls of the playbase form only a part of the overall toy apparatus.
Figure 6B:
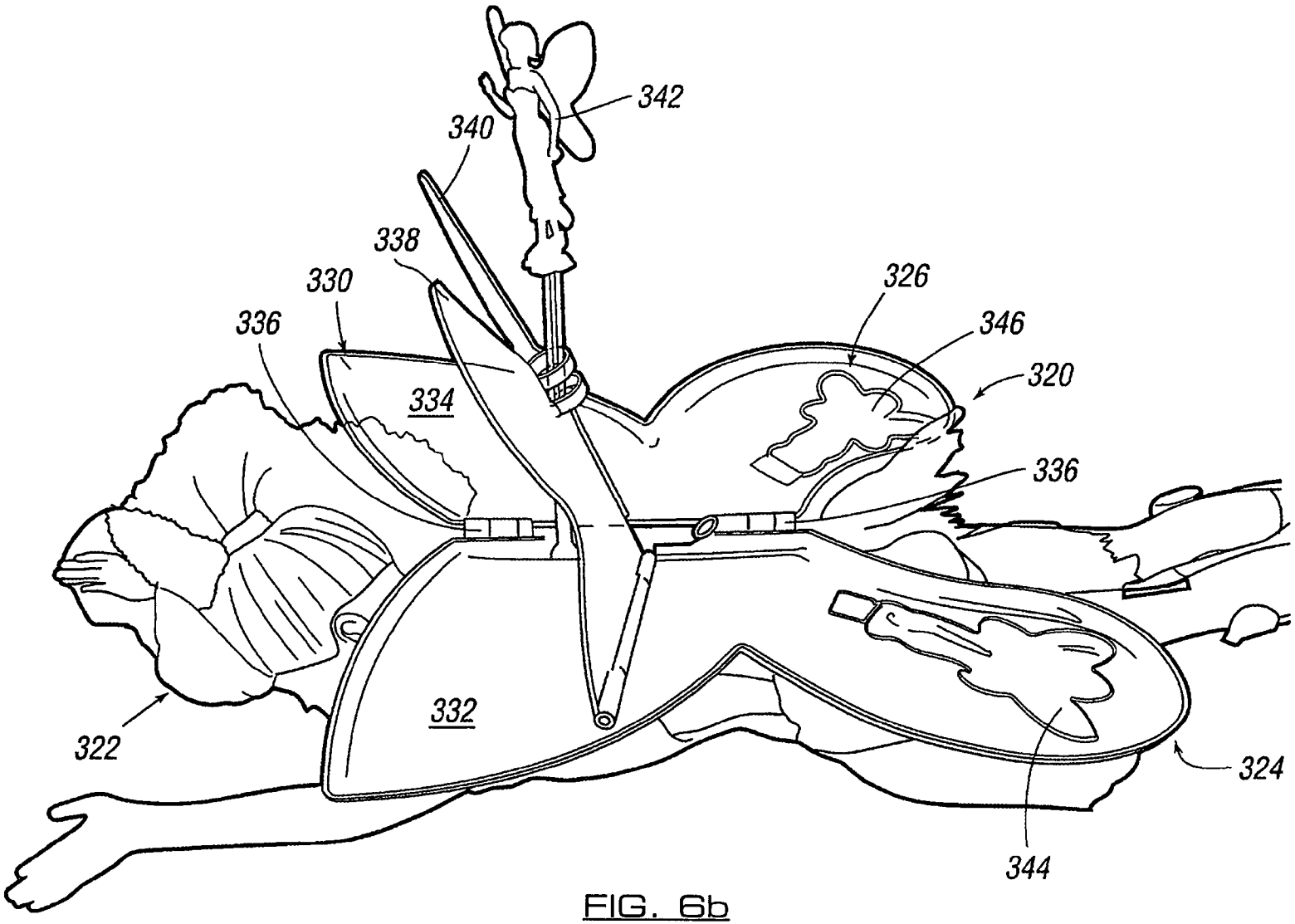

Referring to FIGS. 6*a* and 6*b*, there is illustrated an embodiment of the present invention wherein the playbase 320 forms only a small element of the toy apparatus 322. In this example, the toy apparatus 322 is in the form of a fairy doll having a body, head, arms and legs and the playbase 320 is in the form of wings of the fairy.

The fairy wings include front wing 324 and rear wing 326 having external surfaces 328, 330 respectively. The wings 324, 326 can be held together in a closed position via suitable engagement means. The wings forming the playbase can be moved from the closed position, shown in FIG. 6*a*, to the open position, as shown in FIG. 6*b*. Thus, the internal surfaces 332, 334 of the wings are moved a spaced distance apart by pivoting the same about hinges 336. Pop up members 338, 340 are hingedly connected to internal surface 332, 334 respectively and a further pop up member in the form of a doll FIG. 342 is connected to a surface 348 of the doll. Complementary shaped recesses 344, 346 are defined in internal surfaces 332, 334 to accommodate doll FIG. 342 when the playbase wings are in a closed condition. Thus, doll member 342 is pivotally connected to a surface of the toy apparatus external to and separate from said playbase.

Figure 7A:
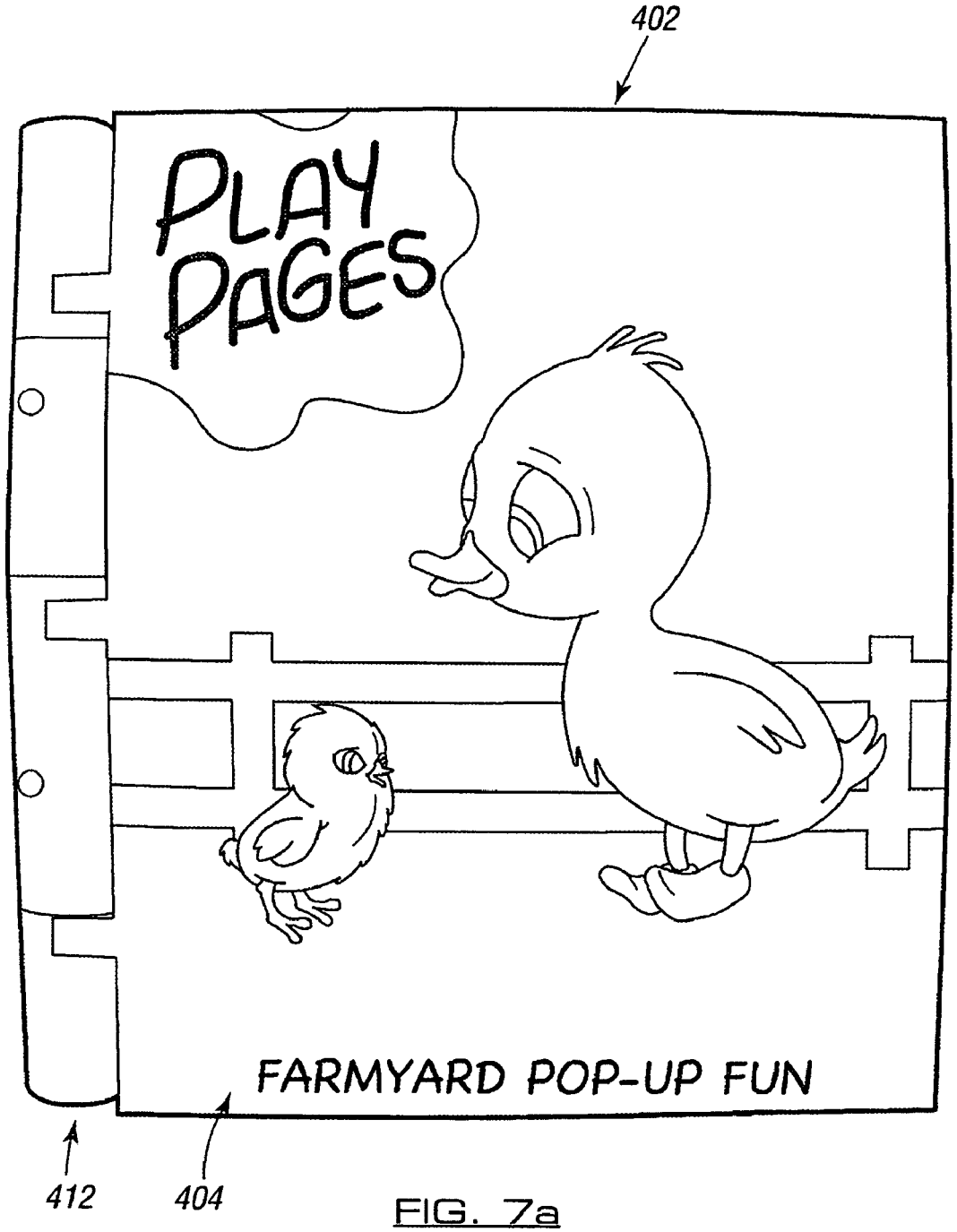
FIGS. 7*a*-7*e* illustrate a further embodiment of the toy apparatus wherein the playbase includes four wall members movable relative to each other between a first closed position and a second open position.
Figure 7B:
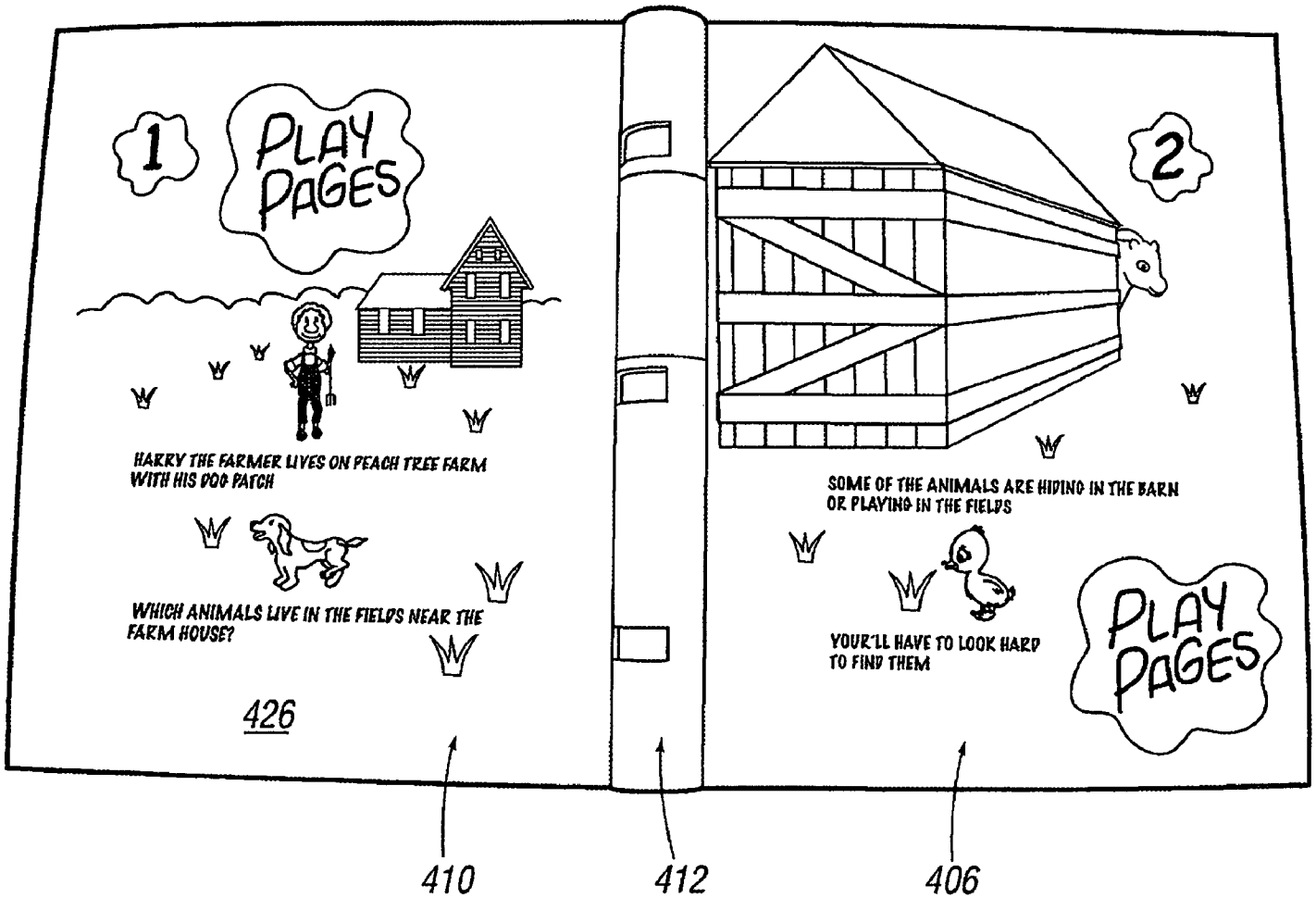
Figure 7C:
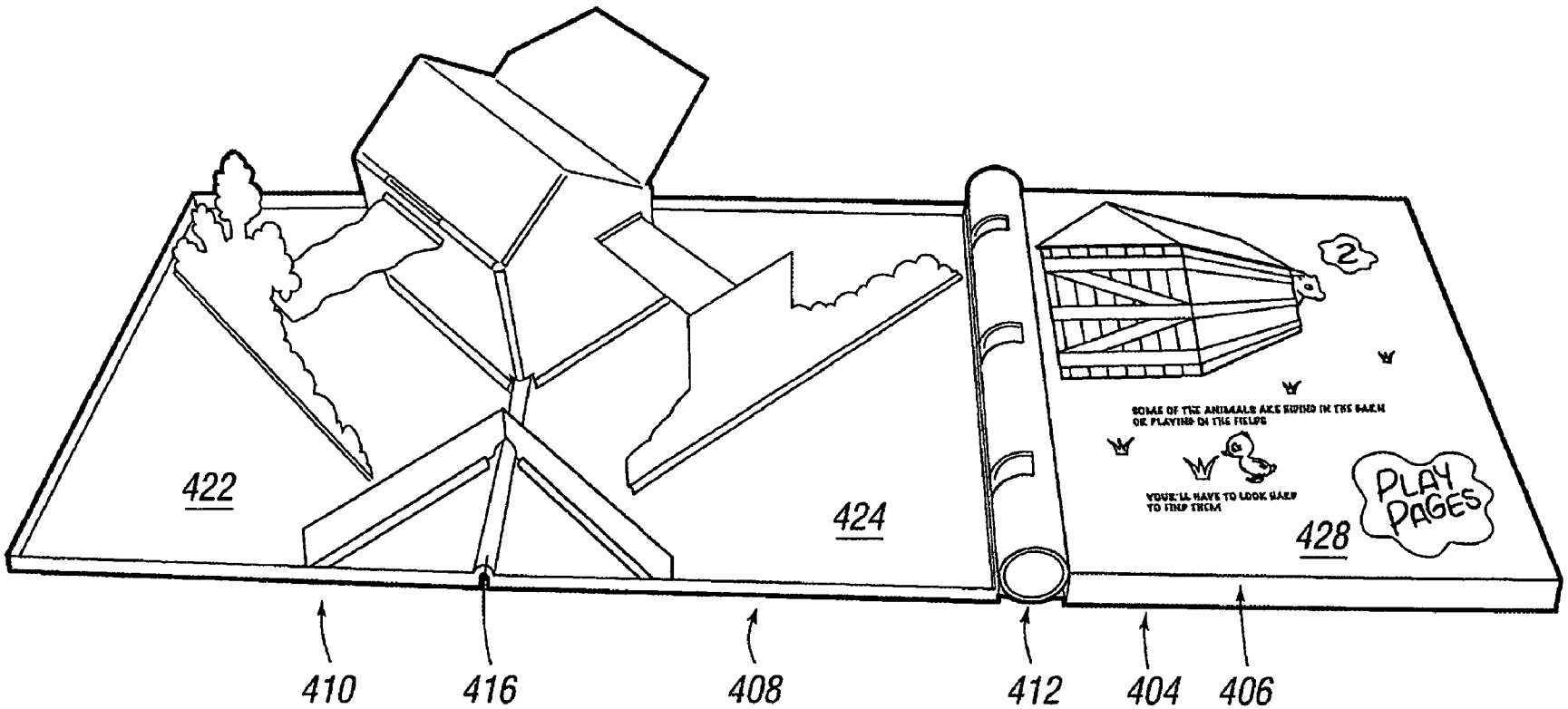
Figure 7D:
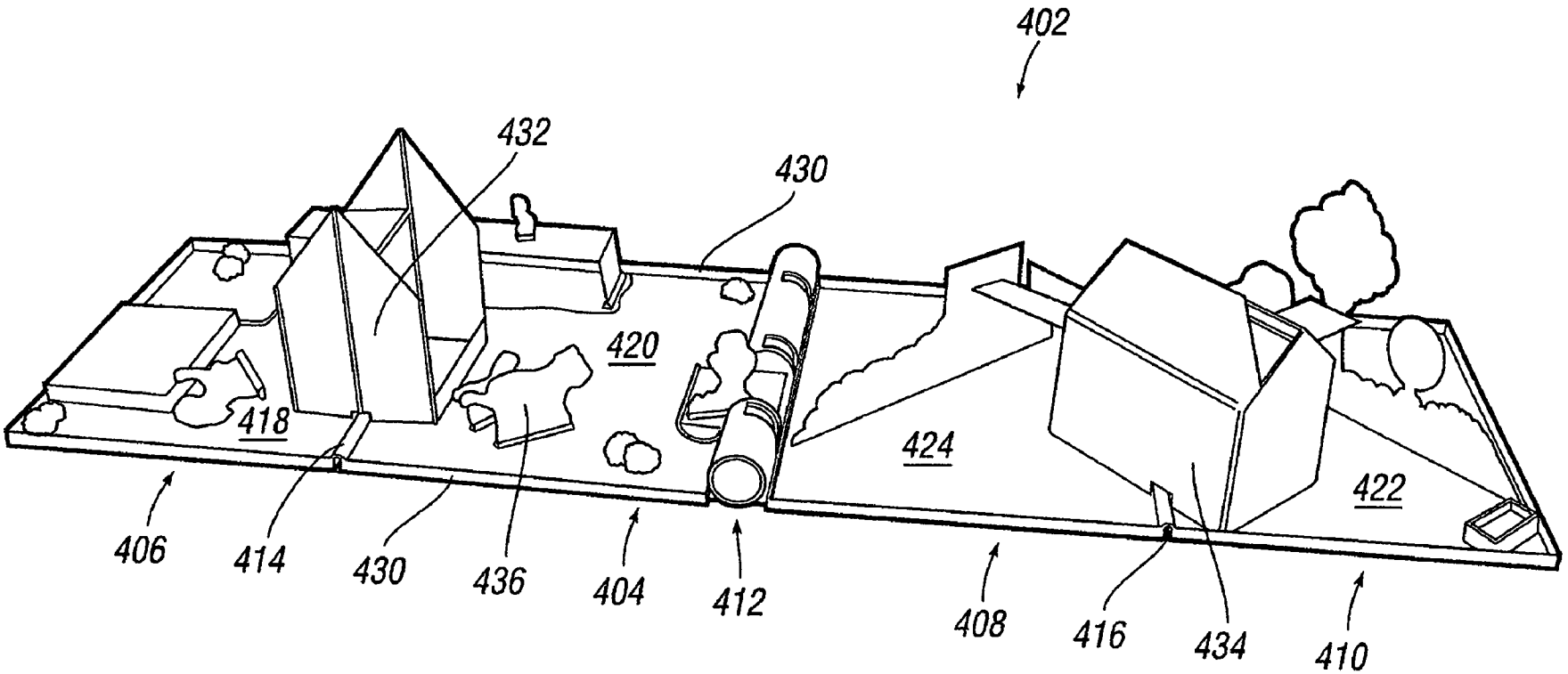

Referring to FIGS. 7*a*-7*e*, there is illustrated an embodiment of the present invention in which the toy apparatus has a playbase 402 including four leaves 404, 406, 408, 410 movable relative to each other between a first closed position, as shown in FIG. 7*a*, to a fully open position, as shown in FIG. 7*d*. FIG. 7*c* illustrates an intermediate play position of the apparatus which can be used for play by a user even though the apparatus is not fully open.

The playbase 402 in this embodiment is designed to give the appearance of a chunky book having a front cover, which is the external surface of leaf 404. Leaf 404 and leaf 408 are joined together via a rotatable hinge member 412. Leaf 406 is joined to leaf 404 via hinge 414 and leaf 408 is joined to leaf 410 via hinge 416.

In a closed position, the internal surface 418 of 406 is moved to an abutting and parallel position with the internal surface 420 of 404, and the internal surface 422 of 410 is moved to an abutting and parallel position with the internal surface 424 of 408. The external surface 426 of leaf 410 is moved to an abutting and parallel position with respect to the external surface 428 of leaf 406. Thus, the leaves of the playbase are moved into overlapping relationship to close the playbase. The leaves are moved in reverse to open the playbase. In the fully opened position, the playbase forms a substantially planar and flat base for a user to play with.

The internal surface of each leaf has an upstanding lip 430 provided around a peripheral edge thereof and the lip 430 of each leaf defines a recess portion therebetween.

Figure 7E:
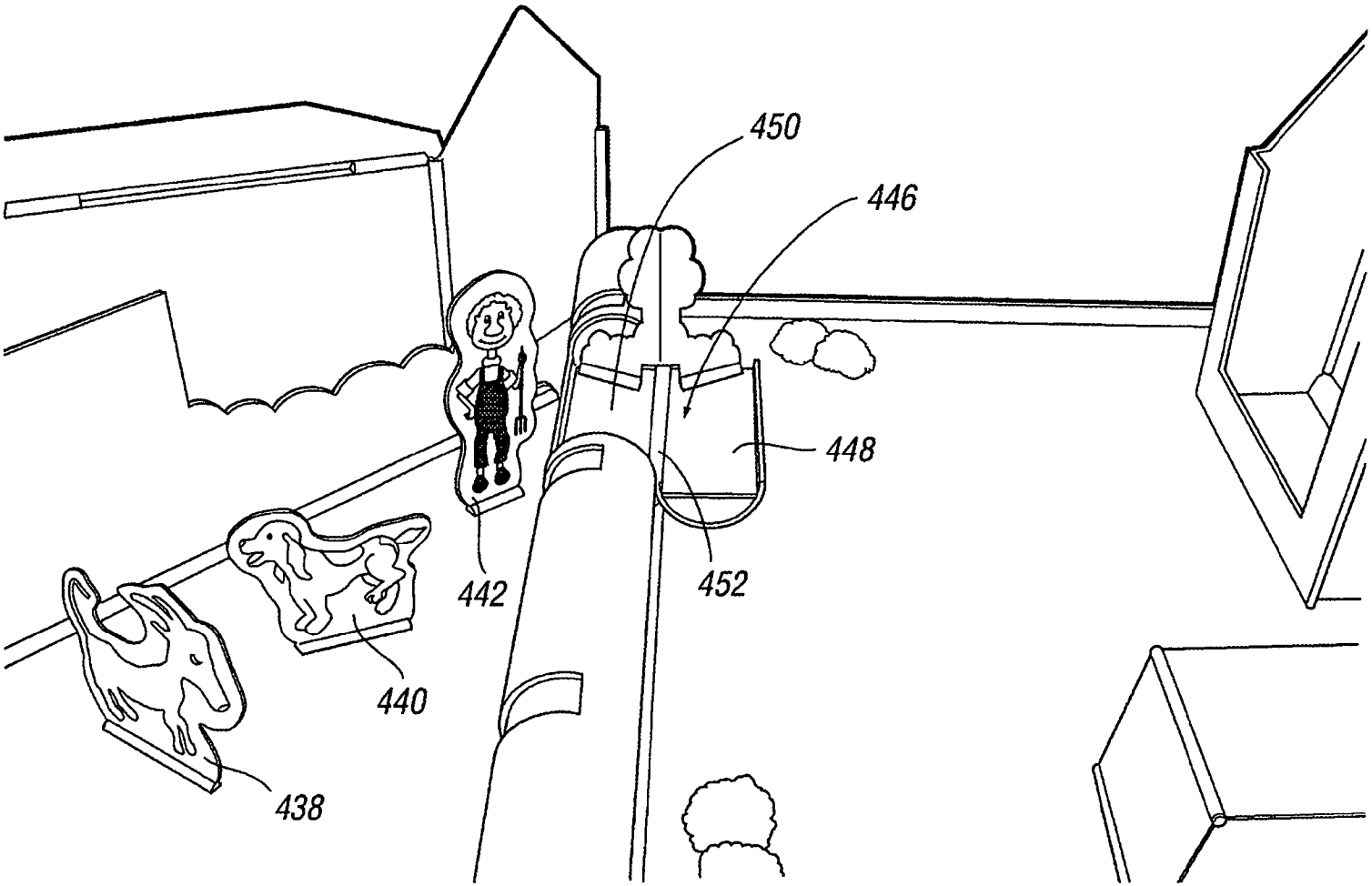

Pop up members are attached to the internal surfaces of the leaves in the recess portions thereof, such that on separation of abutting leaves, the members are moved from a folded or flattened position to an erect position. The members 432, 434 bridging hinges 414, 416 typically pop up automatically upon separation of the connecting leaves. Other members 436 located a distance from hinges 414, 416 may need to be manually moved from a flattened condition to an erect condition by a user. In addition, additional play pieces 438, 440, 442 can be placed on the playbase after the playbase has been moved to an open or partially open condition. These additional play pieces can be located in one or more compartments 446 defined in the hinge arrangement 412 of the apparatus. The compartments 446 typically include a lid portion 448 which is pivotably attached to a base portion 450 about pivot 452 to allow opening and closing of the compartment. A cavity is defined within the compartment for location of the play pieces or further pop-up members, as shown in FIG. 7*e*.

Figure 8A:
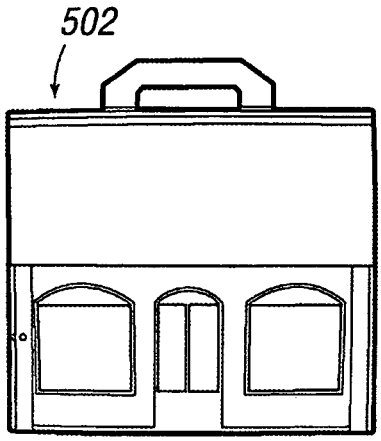
Figure 8B:
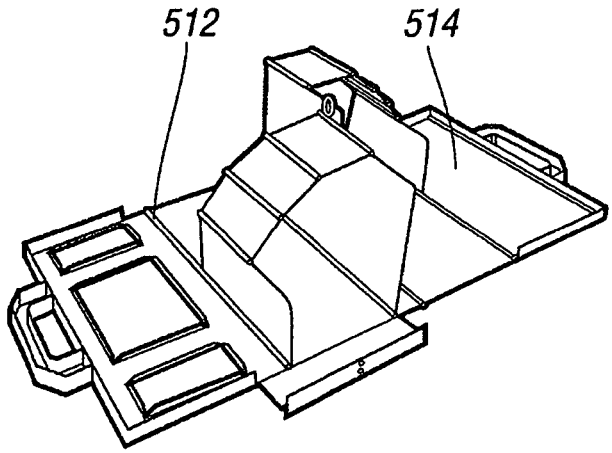
Figure 8C:
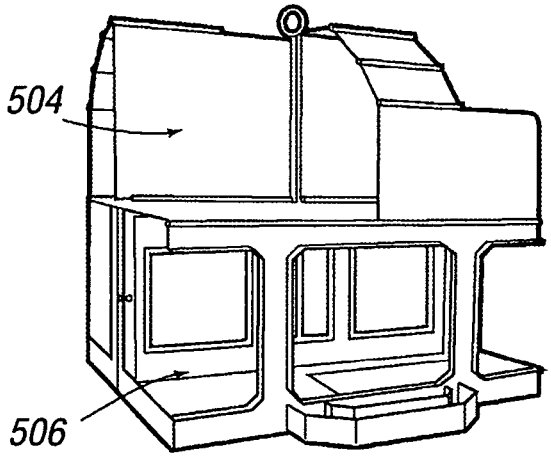
Figure 8D:
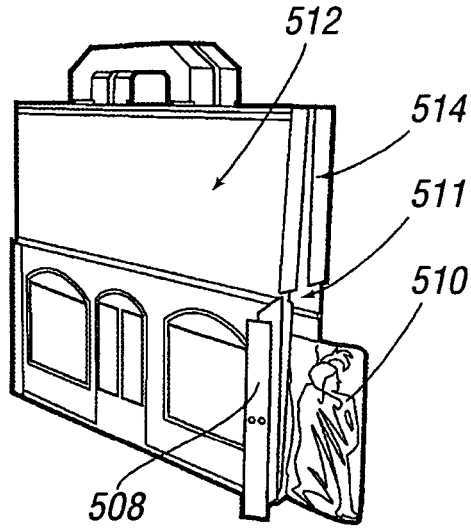

Referring to FIGS. 8*a*-8*d*, there is illustrated an embodiment in the form of a substantially flat case 502 which can be moved from a closed position, as shown in FIG. 8*a*, to an open position, as shown in FIGS. 8*b* and 8*c*. In the open position, the pop-up members can be moved so as to create an upper level 504 and lower level 506 to the playbase, thereby allowing a user to play on both levels of the playbase. The creation of these two levels can be undertaken in a single step process upon opening of the playbase. However, in the illustrated example, creation of the two play levels is typically a two stage process, the first erection stage shown in FIG. 8*b* and the second erection stage shown in FIG. 8*c*. The pop up members are hingedly connected together so that they can be moved to form a substantially rigid 3D structure. Closure means in the form of a pivotable edge or side wall 508 can be provide on the playbase to allow free standing play pieces 510 to be located in a recess 511 created between the playbase leaves 512, 514 when in a closed position.

Figure 9A:
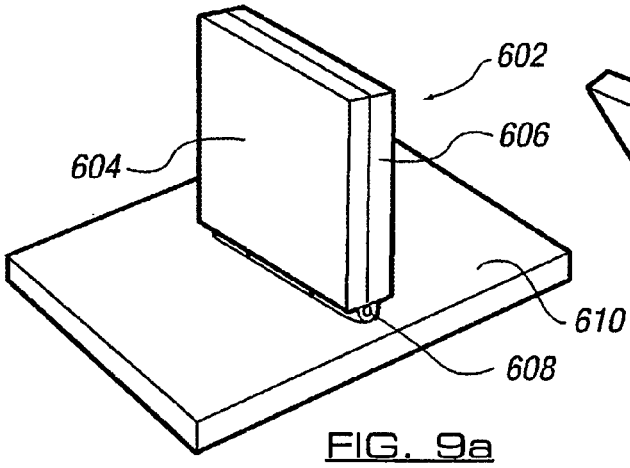
FIGS. 9*a*-9*c* illustrate a further embodiment of the toy apparatus in the form of a car race track wherein the members of the playbase create two or more tiers or levels on the playbase.
Figure 9B:
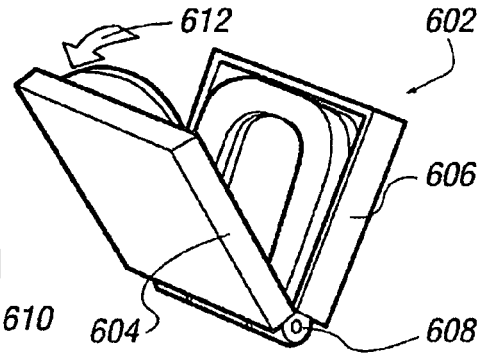
Figure 9C:
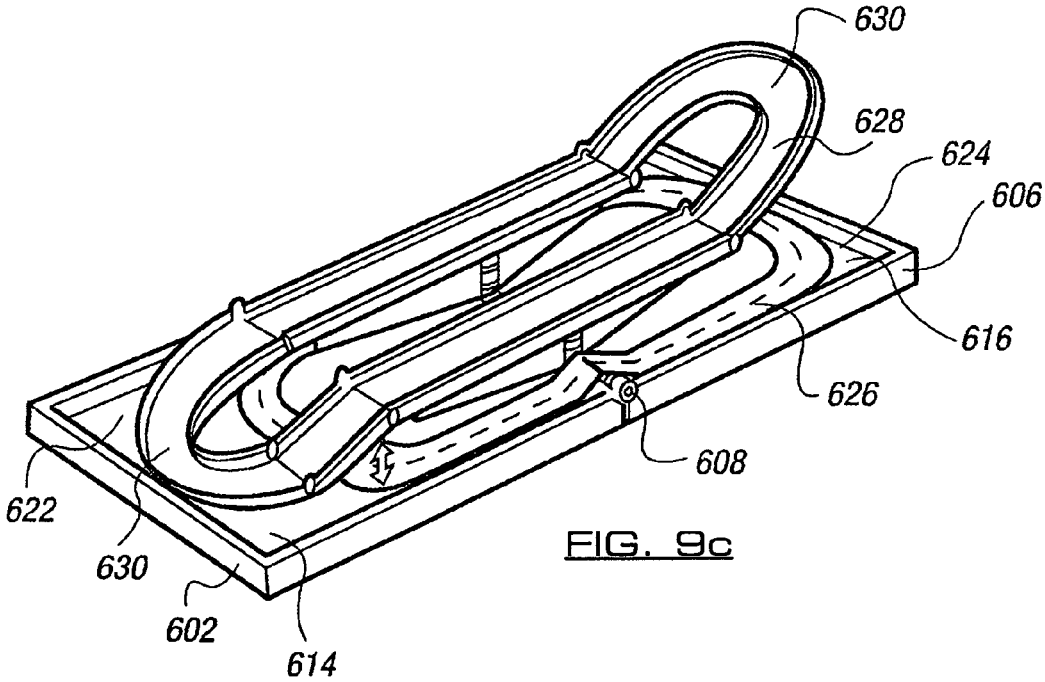

Referring to FIGS. 9*a*-9*c*, there is illustrated an embodiment of the present invention in which toy apparatus in the form of a case 602 having first and second walls 604, 606 arranged in parallel abutting relationship to each other. A hinge 608 joining the first and second walls together is typically placed on a surface 610, as shown in FIG. 9*a* and the walls 604, 606 are moved outwardly of each other about the hinge, as shown by arrow 612 in FIG. 9*b*.

The internal surfaces 614, 616 of walls 604, 606 respectively have side walls or lip 618, 620 around peripheral edges thereof. The side walls 618, 620 define recesses 622, 624 between the side walls and members 626, 628 are located in the recesses. The lower members 626 typically remain in a flattened condition when the case 602 is in both a closed condition and an open in-use position and form a lower car race track surface. The upper members 628 move from a substantially flattened condition with the case 602 in a closed condition, to a substantially erect condition with the case 602 in an open condition to form an upper car race track surface. The outer portions 630 of members 628 can be moved relative to each other and/or to the inner portion and in the example shown are movable under gravity.

Figure 10A:
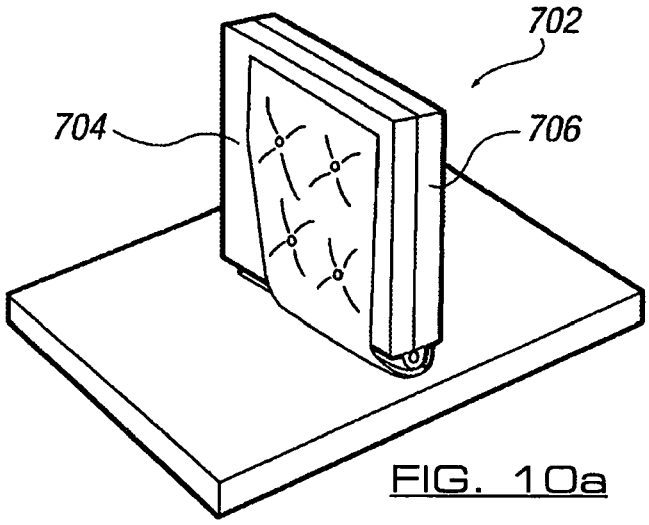
FIGS. 10*a*-10*c* illustrate a yet further embodiment of the toy apparatus in the form of a baby or toddler gym wherein the members of the playbase create two or more levels on the playbase.
Figure 10B:
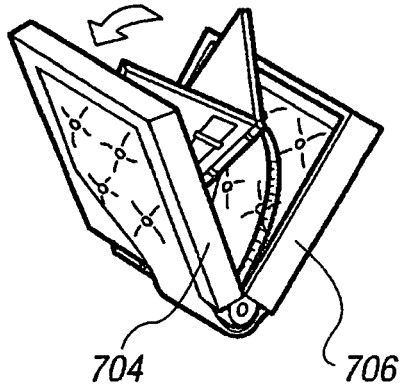
Figure 10C:
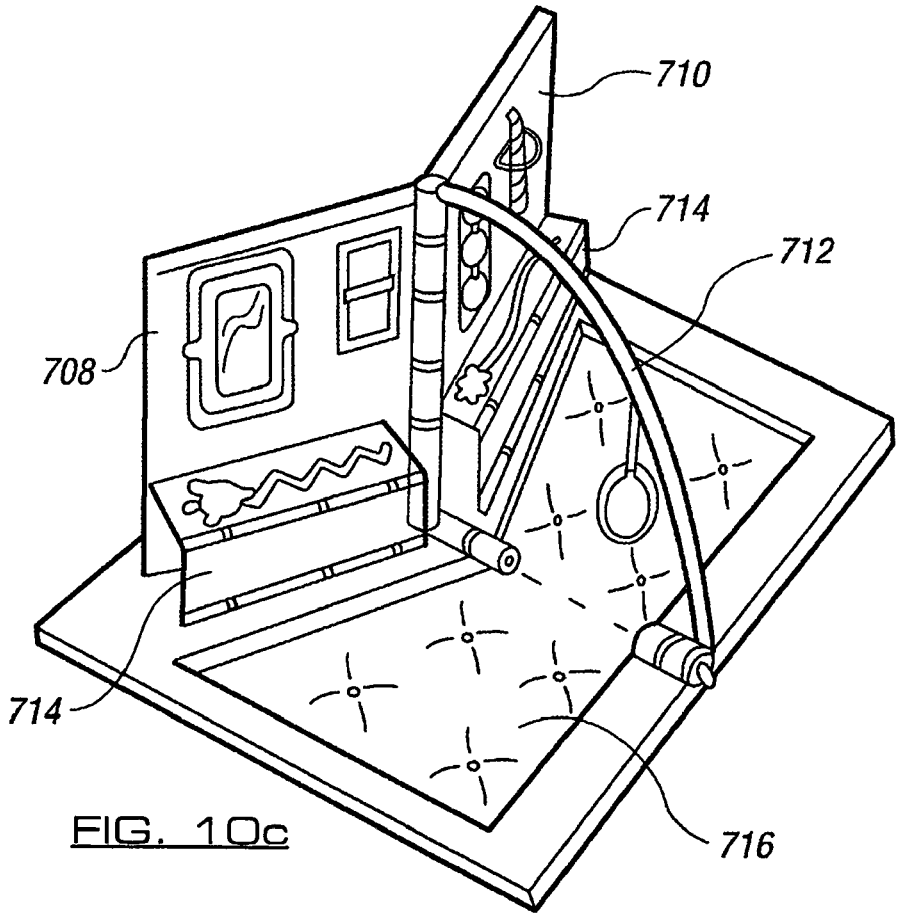
Figure 11A:
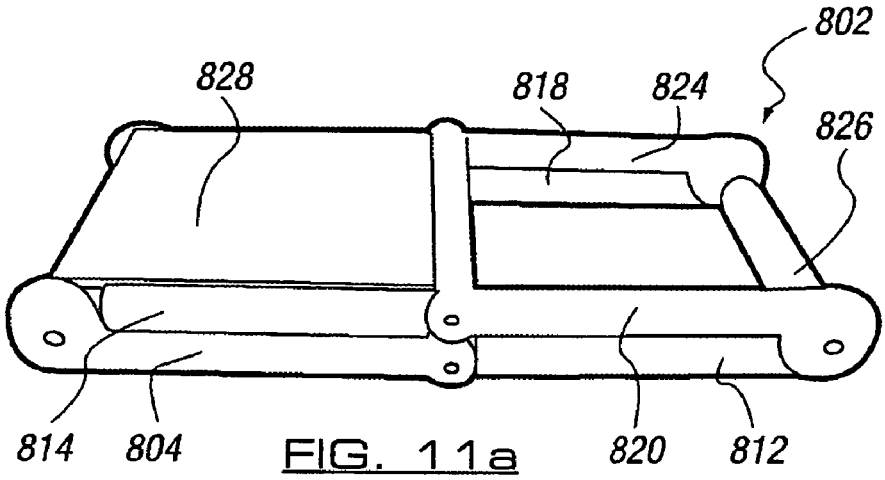
FIGS. 11*a*-11*e* illustrate an embodiment of the present invention wherein part of the playbase is formed from a plurality of frame members which are movable between a substantially flattened condition and a substantially erect condition.
Figure 11B:
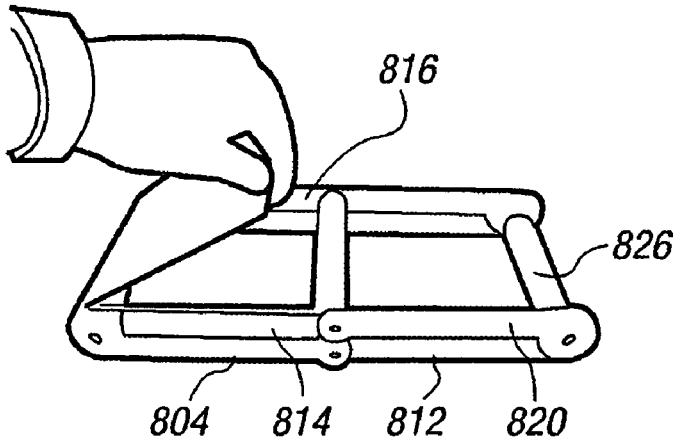
Figure 11C:
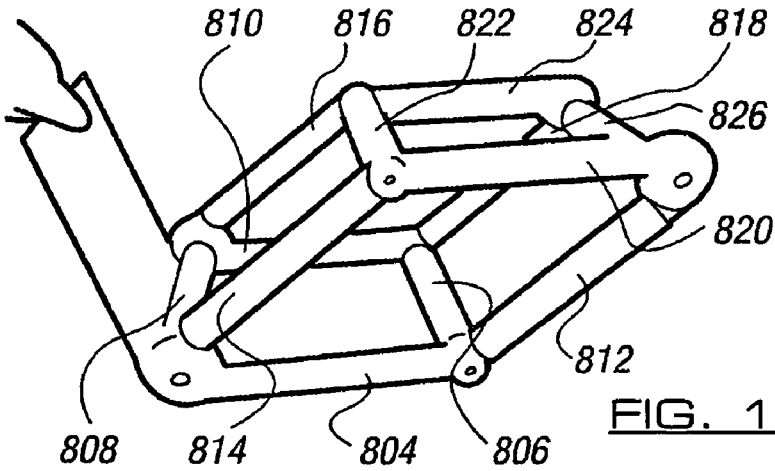
Figure 11D:
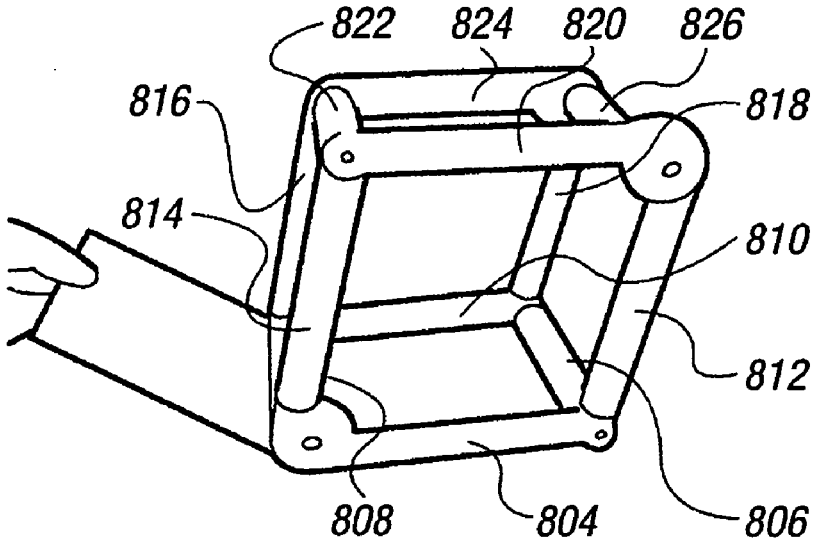
Figure 11E:
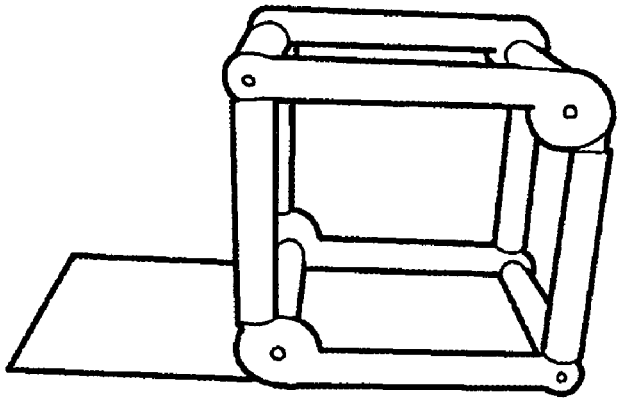
Figure 12A:
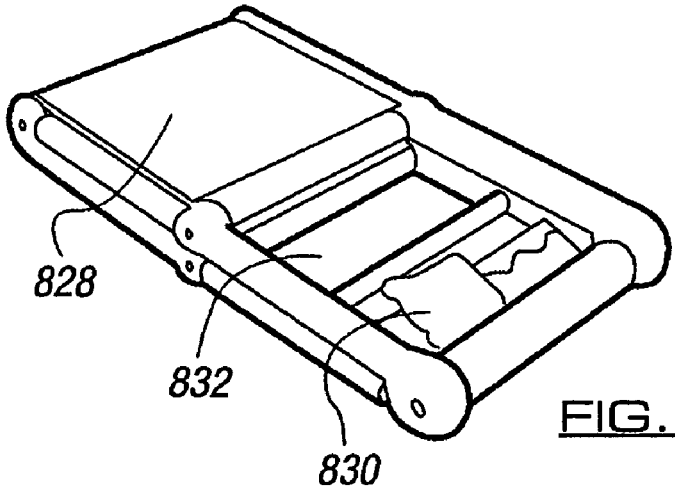

Referring to FIGS. 10*a*-10*c*, there is illustrated an embodiment of the present invention similar to that shown in FIGS. 9*a*-9*c*. A case 702 is formed of substantially larger dimensions to allow a baby to be located on the playbase formed by front and rear walls 704, 706 when the case 702 is in an open condition, as shown in FIG. 10*c*. The surfaces of the playbase are covered in a soft fabric material to provide a soft surface for the baby to play on. Pop-up members 708, 710 are supported in a substantially erect condition by a support member 712 which moves with the members 708, 710 from the flattened condition to an erect condition on movement of the walls 704, 706 from a closed to an open position. Further pop-up members 714 are associated with members 708, 710 and said further pop-up members provide multiple levels of the playbase to allow toy pieces for the baby to play with. The pop-up members are located in recess 716 defined in the internal surfaces of walls 704, 706 when the case is in a closed position.

Referring to FIGS. 11*a*-12*d*, there is illustrated an embodiment of the present invention in which the playbase 802 includes a plurality of frame members which form part of the side walls of the playbase when in a closed position. The frame members include a first set of frame members 804, 806, 808, 810 which define a base of the playbase. A second set of frame members 812, 814, 816, 818 are hingedly connected to the ends of the first set of frame members. A third set of frame members 820, 822, 824, 826 are hingedly connected to the ends of the second set of frame members.

In the closed condition, two of the second set of frame members 814, 816 are substantially parallel to and adjacent two of the first set of frame members 804, 810 and form side walls to the playbase. Two of the second set of frame members

812, 818 form part of the base of the playbase and two of the third set of members 820, 824 are substantially parallel to and adjacent thereto to form side walls to the playbase.

On opening of the playbase, the second set of frame members are moved from a substantially flattened condition, wherein some of the same are substantially parallel to and adjacent some of the first and third sets of frame members, to a substantially erect condition, wherein the second set of frame members are substantially perpendicular to the first and third set of frame members. The final erect form of the toy apparatus is in the form of a cube. A front cover 828 can be connected to the frame members, such that when the front cover is moved from a closed position, wherein the cover is substantially parallel to an adjacent frame members 814, 816, to an open position, wherein the cover is moved outwardly of the playbase, this movement actuates a gear mechanism in the frame members to cause the same to moved from a flattened condition to an erect condition. Thus, movement of the second and third frame members follows movement of the front cover. It will be appreciated by persons skilled in the art that additional pop-up members 830 can be located in the recess 832 defined between some of the frame members and can move with some of the frame members between flattened and erect conditions, as shown in FIGS. 12*a*-12*d*.

Thus, the present invention provides a pop-up toy apparatus, at least part of the apparatus being in a substantially flat condition when in a closed position and movable to a substantially erect condition when in an open position. As such, the toy can be easily transported and takes up only a small amount of space when not being used in the closed position, yet provides a three-dimensional toy which takes up a larger amount of space when in an open in use position.

What is claimed is:

1. A toy apparatus, said toy apparatus in the form of a case or container, said toy apparatus comprising first and second walls, wherein the first and second walls each comprise an inner surface and wherein the first and second walls are pivotably coupled to be movable between a first closed position, wherein the first and second walls are substantially parallel and adjacent to each other, and a second open position, wherein the first and second walls are in a substantially planar configuration, the inner surfaces of the first and second walls forming at least a portion of a playbase when the first and second walls are in the second open position, said playbase including one or more members and said members provided in a substantially flattened condition with said first and second walls in said first closed position and movable with said playbase to a partial or substantially erect condition with said first and second walls in said second open position and wherein at least one of said one or more members is provided in at least one recess in said playbase when the first and second walls are in said first closed condition, wherein at least one of said one or more members automatically pops up upon said playbase transitioning from said first closed position to said second open position, wherein a storage volume is defined in or between said first and second walls in said first closed position for the location of one or more play pieces for use with the apparatus, wherein the members form two or more levels or tiers with the playbase in an erect condition.

2. The toy apparatus according to claim 1 wherein in the flattened condition, an upper surface of the one or more members can be substantially flush with a surface of the playbase, adjacent to and substantially parallel with a surface of the playbase and/or recessed with respect to a surface of the playbase.

3. The toy apparatus according to claim 1 wherein in the erect condition, the one or more members protrude outwardly of a playbase surface.

4. The toy apparatus according to claim 1 wherein in the erect condition, the one or more members protrude substantially perpendicularly from a playbase surface.

5. The toy apparatus according to claim 1 wherein the one or more members are substantially rigid in form.

6. The toy apparatus according to claim 1 wherein the one or more members are substantially flexible in form.

7. The toy apparatus according to claim 1 wherein the one or more recesses are of a substantially similar shape and/or dimensions to the one or more members located therein in the flattened condition.

8. The toy apparatus according to claim 1 wherein the one or more recesses are a different shape to the one or more members located therein in the flattened condition.

9. The toy apparatus according to claim 1 wherein the one or more members are formed by cutting the same from a surface of the playbase.

10. The toy apparatus according to claim 1 wherein the one or more members are formed from a source other than the playbase and, when formed, are attached to the playbase in use.

11. The toy apparatus according to claim 1 wherein lip means are provided on the playbase and at least one recess is defined within or between said lip means.

12. The toy apparatus according to claim 11 wherein the lip means are provided around a peripheral edge of one or more surfaces forming the playbase.

13. The toy apparatus according to claim 1 wherein two or more members are located in a single recess on said playbase.

14. The toy apparatus according to claim 13 wherein the two or more members are located side by side in the recess.

15. The toy apparatus according to claim 13 wherein the two or more members are located in the recess in an overlapping arrangement to form a stack.

16. The toy apparatus according to claim 1 wherein two or more members provided on the playbase are moved to form a three dimensional structure and/or article when the playbase is moved from the flattened condition to the erect condition.

17. The toy apparatus according to claim 16 wherein the two or more members are separate from each other when the playbase is in the flattened condition and are brought into engagement or contact with each other when the playbase is moved to an erect condition.

18. The toy apparatus according to claim 16 wherein the two or more members contact each other or are joined together in both the flattened and erect conditions.

19. The toy apparatus according to claim 16 wherein the two or more members are hingedly, rotatably and/or pivotably connected to each other.

20. The toy apparatus according to claim 1 wherein the one or more members are hingedly, pivotally and/or rotatably mounted to at least one surface of the playbase.

21. The toy apparatus according to claim 1, the levels or tiers spaced apart in the vertical direction.

22. The toy apparatus according to claim 21 wherein the two or more levels or tiers are formed in a one or more stage process once the playbase is in an open position.

23. The toy apparatus according to claim 21 wherein the two or more levels or tiers are formed substantially simultaneously on opening of the playbase.

24. The toy apparatus according to claim 19 or 20 wherein the hinge means includes magnetically detachably attached hinge means.

25. The toy apparatus according to claim 1 wherein the one or more members are resiliently biased to the erect condition via resilient biasing means.

26. The toy apparatus according to claim 1 wherein the one or more members are moved to an erect condition on user actuation of an actuation mechanism.

27. The toy apparatus according to claim 1 wherein the playbase and/or the one or more members are provided with printed matter, graphics, texture, colour, photographs, text or images thereon.

28. The toy apparatus according to claim 1 wherein the playbase includes at least front and rear panels, the internal surfaces of said front and real panels are adjacent, abutting or in overlapping relationship with each other in the first closed position and are moved a spaced distance apart in the second open position.

29. The toy apparatus according to claim 28 wherein the playbase panels are substantially parallel to and adjacent each other in said first closed position, the panels being moved to a spaced distance apart to be in a substantially planar or flat configuration in the second open position.

30. The toy apparatus according to claim 28 wherein hinge or pivot means connect the at least front and rear panels of the playbase together.

31. The toy apparatus according to claim 30 wherein one or more compartments or storage volume are provided on or in association with the hinge means.

32. The toy apparatus according to claim 31 wherein the compartment includes closure means to allow opening and closing of said compartment.

33. The toy apparatus according to claim 28 wherein at least one member is provided in association with the front panel and at least one further member is provided in association with the rear panel, the members being joined together along at least a part of an edge or surface, such that when the front and rear panels are moved to an open position, the engagement between the members causes the members to move from a flattened condition to an erect condition.

34. The toy apparatus according to claim 33 wherein the join or connection between the members is located substantially centrally of the connection between the front and rear panels of the playbase.

35. The toy apparatus according to claim 1 wherein erection of the members takes place when panels forming the playbase are moved a pre-determined distance apart from each other.

36. The toy apparatus according to claim 35 wherein erection of the members takes place when the external surfaces of the playbase in the closed position are moved into abutting relationship with each other in an open position.

37. The toy apparatus according to claim 1 wherein one or more members are movably connected to a part of the apparatus other than the playbase.

38. The toy apparatus according to claim 1 wherein the playbase is formed from two or more panels, each hingedly connected to an adjacent leaf, panel or wall.

39. The toy apparatus according to claim 1 wherein one or more side wall or edges of the playbase have closure means associated therewith, opening of the closure means allowing access to a recess defined in the playbase with the playbase in a closed condition.

40. The toy apparatus according to claim 1 wherein the playbase includes or is formed from frame means.

41. The toy apparatus according to claim 40 wherein at least one of said frame means is movable from a substantially flattened condition to a substantially erect condition on opening of said playbase.

42. The toy apparatus according to claim 1 wherein at least a part of the outer surface of at least front and rear panels is substantially planar or flat in form.

43. The toy apparatus according to claim 1 wherein one or more handles are provided on the apparatus.

44. The toy apparatus according to claim 1 wherein the playbase is movable between one or more intermediate positions between said open and closed positions.

45. The toy apparatus according to claim 44 wherein one or more of the intermediate positions have play value associated therewith.

46. The toy apparatus according to claim 1, wherein the storage volume for location of the one or more play pieces forms part of the at least one recess.

47. The toy apparatus according to claim 1, wherein the storage volume for location of the one or more play pieces is in addition to or separate to the at least one recess.

48. The toy apparatus according to claim 1 wherein the one or more members have one or more portions attached thereto and said portions can move relative to said one or more members.

49. The toy apparatus according to claim 1 wherein locking means are provided to maintain the playbase in a closed and/or open position.

50. The toy apparatus according to claim 1 wherein the one or more members are substantially flat or planar in form when in the flattened condition.

51. The toy apparatus according to claim 1 wherein the playbase is used in a substantially horizontal orientation when in an open position.

52. The toy apparatus according to claim 1 wherein the playbase is used in a substantially vertical orientation when in an open position.

53. The toy apparatus according to claim 1 wherein one or more panels forming the playbase are movable between any angle from 0-360 degrees to form the closed and open positions.

54. The toy apparatus according to claim 1 wherein panels forming the playbase differ in shape, size and/or design.

55. The toy apparatus according to claim 1 wherein one or more panels forming the playbase are located wholly or partially within the outermost boundaries of one other wall, panel or leaf forming the playbase in at least the closed position.

56. The toy apparatus according to claim 1 wherein the playbase forms only part of the overall toy apparatus.

57. The toy apparatus according to claim 47 wherein the overall toy apparatus is in the form of a doll, animal, human or character and the playbase forms a part of the doll, animal, human or character.

58. A method of use of the toy apparatus, said toy apparatus in the form of a case or container, said toy apparatus including a playbase and a first wall pivotably coupled to a second wall, and said method comprising the steps of: moving the first and second walls from a first closed position in which the first and second walls are substantially parallel and adjacent to each other, to a second open position, wherein the first and second walls are in a substantially planar configuration, said playbase including one or more members and said members provided in a substantially flattened condition with said first and second walls in said first closed position and movable with said playbase to a partial or substantially erect condition with said first and second walls in said second open position and wherein at least one of said one or more members is provided in at least one recess in said playbase in said first closed condition, wherein at least one of said one or more members automatically pops up upon transitioning from said first closed position to said second open position, wherein a storage volume is defined in or between said first and second walls in said first closed position for the location of one or more play pieces for use with the apparatus, wherein said one or more members form two or more levels or tiers with said playbase in an erect condition.

59. A toy apparatus, said toy apparatus comprising first and second walls, wherein the first and second walls each comprise an inner surface and wherein the first and second walls are pivotably coupled to be movable between a first closed position, wherein the first and second walls are substantially parallel and adjacent to each other, and a second open position, wherein the first and second walls are in a substantially planar configuration, the inner surfaces of the first and second walls forming at least a portion of a playbase when the first and second walls are in the second open position, said playbase including one or more members and said members provided in a substantially flattened condition with said first and second walls in said first closed position and movable with said playbase to a partial or substantially erect condition with said first and second walls in said second open position, wherein at least one of said one or more members automatically pops up upon transitioning from said first closed position to said second open position, wherein said one or more members form two or more levels or tiers with said playbase in an erect condition.

60. A toy apparatus, said toy apparatus comprising first wall, wherein the first wall comprises an inner surface and wherein the first wall is pivotably movable from a first closed position by about 180 degrees to a second open position, wherein the inner surfaces of the first wall forms at least a portion of a playbase when the first wall is in the second open position, said playbase including one or more members and said members provided in a substantially flattened condition with said first wall in said first closed position and movable with said playbase to a partial or substantially erect condition with said first wall in said second open position, wherein at least one of said one or more members automatically pops up upon transitioning from said first closed position to said second open position, wherein said one or more members form two or more levels or tiers with said playbase in an erect condition.

* * * * *